US009966159B2

(12) United States Patent
van Arendonk et al.

(10) Patent No.: US 9,966,159 B2
(45) Date of Patent: May 8, 2018

(54) VARIABLE APERTURE FOR CONTROLLING ELECTROMAGNETIC RADIATION

(71) Applicant: Teledyne Dalsa, Inc., Waterloo (CA)

(72) Inventors: Anton van Arendonk, Waterloo (CA); Andrey Lomako, Waterloo (CA)

(73) Assignee: TELEDYNE DALSA, INC., Waterloo, Ontario (CA)

( * ) Notice: Subject to any disclaimer, the term of this patent is extended or adjusted under 35 U.S.C. 154(b) by 285 days.

(21) Appl. No.: 14/826,297

(22) Filed: Aug. 14, 2015

(65) Prior Publication Data

US 2017/0047137 A1 Feb. 16, 2017

(51) Int. Cl.
*G21K 1/04* (2006.01)

(52) U.S. Cl.
CPC ..... *G21K 1/04* (2013.01)

(58) Field of Classification Search
CPC . G21K 1/10; G21K 1/04; G21K 1/025; A61B 6/06; A61B 6/4035; G01N 2223/313
See application file for complete search history.

(56) References Cited

U.S. PATENT DOCUMENTS 3,944,836 A 3/1976 Piret et al.
4,856,042 A 8/1989 Staron et al.
5,559,853 A 9/1996 Linders et al.
5,596,619 A 1/1997 Carol
5,625,665 A 4/1997 Fokkink et al.
5,802,136 A 9/1998 Carol
5,878,111 A * 3/1999 Schulz ..... G21K 1/10 378/158
6,061,426 A 5/2000 Linders et al.
6,201,852 B1 3/2001 Goddu et al.
6,252,939 B1 6/2001 Young et al.
6,370,228 B1 * 4/2002 Mockler ..... G21K 1/10 378/156

(Continued)

OTHER PUBLICATIONS

Lee et al., "Electrowetting and electrowetting-on-dielectric for microscale liquid handling", Sensors and Actuators A 95, Elsevier (2002) pp. 259-268.

(Continued)

*Primary Examiner* — David J Makiya
*Assistant Examiner* — Soorena Kefayati
(74) *Attorney, Agent, or Firm* — K&L Gates LLP

(57) ABSTRACT

An apparatus comprising a variable aperture for controlling electromagnetic radiation and related systems and methods are described. In one aspect, a variable aperture to control electromagnetic radiation comprises a first substrate, a second substrate, an attenuation fluid, at least one charging electrode, and at least one displacing electrode. The second substrate is located opposite the first substrate and spaced apart from the first substrate to form a gap between the first substrate and the second substrate. The attenuation fluid is located in the gap and configured to absorb electromagnetic radiation of a predetermined wavelength. The at least one charging electrode is in electrical contact with the attentional fluid. The at least one displacing electrode is located on a surface of the first substrate facing the gap or on a surface of the second substrate facing the gap.

20 Claims, 27 Drawing Sheets

(56) References Cited

U.S. PATENT DOCUMENTS

| | | | | |
|---|---|---|---|---|
| 6,424,698 | B1 * | 7/2002 | Weekamp | G21K 1/10 378/156 |
| 6,438,211 | B1 | 8/2002 | Weekamp et al. | |
| 6,453,012 | B2 * | 9/2002 | Herbert | G02B 26/005 378/156 |
| 6,473,492 | B2 | 10/2002 | Prins et al. | |
| 6,920,203 | B2 | 7/2005 | Short et al. | |
| 7,652,273 | B2 * | 1/2010 | Cernasov | A61B 6/06 250/505.1 |
| 8,971,497 | B2 * | 3/2015 | Haider | G21K 1/10 378/147 |
| 8,971,498 | B2 * | 3/2015 | Haider | G21K 1/10 378/147 |
| 9,165,693 | B2 * | 10/2015 | Urbanus | G21K 1/02 |
| 2001/0040938 | A1 | 11/2001 | Prins | |
| 2001/0043670 | A1 | 11/2001 | Prins | |
| 2008/0048135 | A1 | 2/2008 | Cernasov | |
| 2008/0237482 | A1 | 10/2008 | Shahar et al. | |
| 2013/0301807 | A1 * | 11/2013 | Bernhardt | G21K 1/10 378/158 |
| 2013/0322604 | A1 * | 12/2013 | Liegl | G21K 1/10 378/159 |
| 2014/0158894 | A1 * | 6/2014 | Wang | G21K 5/00 250/372 |

OTHER PUBLICATIONS

Mugele et al., "Electrowetting: from basics to applications", Institute of Physics Publishing, J. Phys.: Condens. Matter 17 (2005) R705-R774.

* cited by examiner

VARIABLE APERTURE FOR CONTROLLING ELECTROMAGNETIC RADIATION

BACKGROUND

The information described in this background section is not admitted to be prior art.

Systems employing high energy electromagnetic radiation within certain wavelength ranges use collimators and filter devices to control the propagation direction, size, shape, intensity, and dynamic range of an electromagnetic radiation beam (e.g., an X-ray beam or a gamma-ray beam). A collimator, for example, generally comprises a structure made of a material (e.g., lead or lead alloys) that absorbs electromagnetic radiation within a certain wavelength range (e.g., 0.01-10 nanometers for X-rays). A collimator comprises an aperture in the absorbing material through which electromagnetic radiation can propagate. A collimator, for example, can be physically located between an X-ray source and a target to direct a collimated X-ray beam onto the target.

Similarly, an electromagnetic radiation filter generally comprises a material that at least partially absorbs electromagnetic radiation so that some incident radiation is absorbed and the remainder passed, thus decreasing the intensity and dynamic range of an incident electromagnetic radiation beam. An electromagnetic radiation filter, for example, can be physically located between an X-ray source and a target to control the intensity and dynamic range of an X-ray beam incident on the target.

It would be advantageous to provide variable and dynamic control over the propagation direction, location-on-target, size, shape, intensity, and/or dynamic range of electromagnetic radiation such as, for example, X-ray radiation and/or a gamma-ray radiation.

SUMMARY

This specification describes an apparatus comprising a variable aperture for controlling electromagnetic radiation. This specification also describes a method for controlling electromagnetic radiation with an apparatus comprising a variable aperture. This specification also describes an electromagnetic radiation system comprising an apparatus comprising a variable aperture.

In one example, an apparatus is described for providing a variable aperture to control electromagnetic radiation. The apparatus comprises a first substrate and a second substrate located opposite the first substrate and spaced apart from the first substrate to form a gap between the first substrate and the second substrate. An attenuation fluid is located in the gap between the first substrate and the second substrate. The attenuation fluid at least partially absorbs electromagnetic radiation in a predetermined wavelength range. At least one charging electrode is in electrical contact with the attenuation fluid. At least one displacing electrode is located on a surface of the first substrate facing the gap or on a surface of the second substrate facing the gap.

In another example, an apparatus is described for providing a variable X-ray aperture. The apparatus comprises a first substrate and a second substrate located opposite the first substrate and spaced apart from the first substrate to form a gap between the first substrate and the second substrate. An X-ray attenuation fluid is located in the gap between the first substrate and the second substrate. At least one charging electrode is in electrical contact with the X-ray attenuation fluid. At least one displacing electrode is located on a surface of the first substrate facing the gap or on a surface of the second substrate facing the gap.

In another example, an apparatus is described for providing a variable X-ray aperture. The apparatus comprises a first substrate and a second substrate located opposite the first substrate, and spaced apart from the first substrate to form a gap between the first substrate and the second substrate. A mercury layer is located in the gap between the first substrate and the second substrate. The mercury layer is in contact with a surface of the first substrate facing the gap and a surface of the second substrate facing the gap. At least one charging electrode is in electrical contact with the mercury layer. At least one displacing electrode is located on the surface of the first substrate facing the gap or on the surface of the second substrate facing the gap. A controller is operably coupled to the at least one displacing electrode. The controller is configured to provide the displacing electrode with an electrical charge that displaces the mercury layer from at least a portion of the gap by electrostatic force between the displacing electrode and the mercury layer.

In another example, a method is described for controlling electromagnetic radiation. The method comprises displacing an attenuation fluid with an electrostatic force between the attenuation fluid and a displacing electrode. The displacing changes the location, size, and/or shape of an open aperture in a layer of the attenuation fluid. Electromagnetic radiation can be provided through the open aperture in the attenuation fluid layer.

In another example, a method is described for controlling X-ray radiation. The method comprises displacing an X-ray attenuation fluid with an electrostatic force between the X-ray attenuation fluid and a displacing electrode. The displacing changes the location, size, and/or shape of an open aperture in a layer of the X-ray attenuation fluid. X-ray radiation can be provided through the open aperture in the X-ray attenuation fluid layer.

It is understood that the inventions described in this specification include but are not necessarily limited to the examples summarized in this Summary.

BRIEF DESCRIPTION OF THE DRAWINGS

Various features and characteristics of the inventions described in this specification may be better understood by reference to the accompanying figures, in which.

The reader will appreciate the foregoing features and characteristics, and others, upon considering the following detailed description of the inventions according to this specification.

DESCRIPTION

Figure 1A:
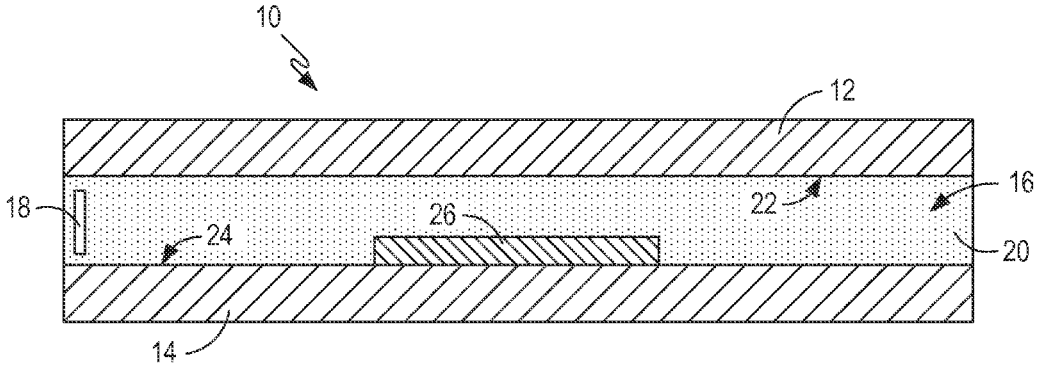
FIG. 1A is a cross-sectional schematic diagram of an apparatus for providing a variable aperture to control electromagnetic radiation, the apparatus comprising first and second opposed substrates, an attenuation fluid located in a gap between the first and second opposed substrates, a charging electrode, and a displacing electrode.
Figure 1B:
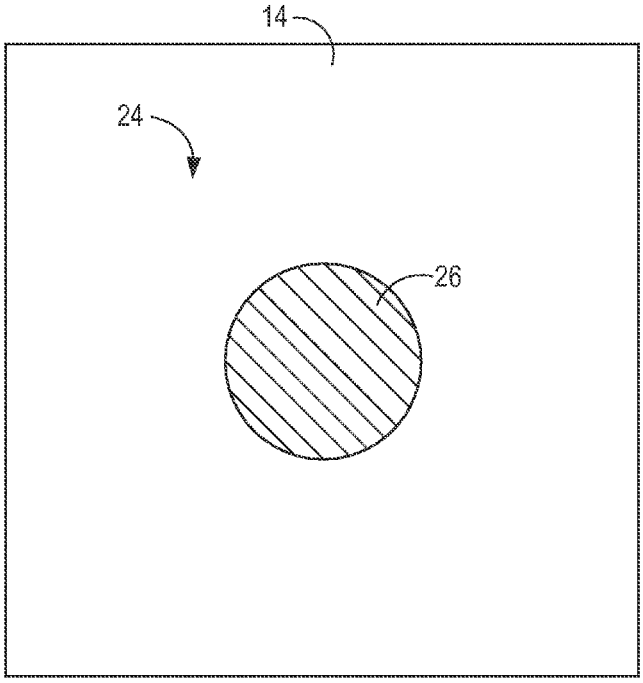
FIG. 1B is a top view schematic diagram of the second substrate and the displacing electrode shown in FIG. 1A.

Referring to FIGS. 1A and 1B, an apparatus 10 for providing a variable aperture to control electromagnetic radiation comprises a first substrate 12 and a second substrate 14. The second substrate 14 is located opposite the first substrate 12 and is spaced apart from the first substrate 12 to form a gap 16 between the first substrate 12 and the second substrate 14. An attenuation fluid 20 is located in the gap 16 between the first substrate 12 and the second substrate 14. A charging electrode 18 is in electrical contact with the attenuation fluid 20. A displacing electrode 26 is located on a surface 24 of the second substrate 14 facing the gap 16 (and although not shown in FIG. 1A, the displacing electrode 26 can alternatively be located on a surface 22 of the first substrate 12 facing the gap 16).

The first substrate 12 and the second substrate 14 comprise materials of construction that are relatively transparent to the subject electromagnetic radiation (e.g., X-rays having a wavelength in the range of 0.01 to 10 nanometers) and do not absorb or otherwise attenuate appreciable amounts of the electromagnetic radiation. For example, the first substrate 12 and the second substrate 14 can independently comprise aluminum, an aluminum alloy, glass, or silicon, or combinations of any thereof.

The attenuation fluid 20 is configured to at least partially absorb electromagnetic radiation of a predetermined wavelength (e.g., X-rays having a wavelength in the range of 0.01 to 10 nanometers) and thus completely absorb or at least decrease the intensity of (i.e., attenuate) incident electromagnetic radiation passing through the attenuation fluid. For example, the attenuation fluid 20 can comprise a fluid metal or fluid alloy such as, for example, mercury, gallium-indium-tin alloys (Galinstan alloys), gallium-indium-tin-zinc alloys, gallium-indium alloys, molten bismuth, or molten lead. The attenuation fluid 20 can also comprise a nanofluid. For example, an attenuation nanofluid can comprise a suspension of lead or lead alloy nanoparticles (i.e., having an average particle size of 1-1,000 nanometers) in a base fluid such as water, aqueous solutions, and oils. The attenuation fluid 20 can also comprise a microfluid. For example, an attenuation microfluid can comprise a suspension of lead or lead alloy microparticles (i.e., having an average particle size of 1-1,000 micrometers) in a base fluid such as water, aqueous solutions, and oils.

The charging electrode 18 is in direct electrical contact with the attenuation fluid 20 and is configured to provide the attenuation fluid 20 with an electrical charge. The charging electrode 18 can comprise a metallic conductor such as, for example, copper, silver, gold, nickel, palladium, platinum, chromium, molybdenum, tungsten, aluminum, or carbon (including metallic alloys comprising one or more of the listed metallic elements), or combinations of any thereof. The charging electrode 18 can comprise a structure located in the gap 16 such as, for example, a post, a plate, a wire, or other structural form. For example, although not shown in FIGS. 1A and 1B, the charging electrode 18 can comprise one or more conductive traces, tracks, pads, or thin-film electrodes located on the surface 22 of the first substrate 12 facing the gap 16 and/or on the surface 24 of the second substrate 14 facing the gap 16. Charging electrodes comprising conductive traces, tracks, pads, and/or thin-film electrodes can be formed, for example, by depositing and curing conductive inks onto the substrates. The conductor material forming charging electrodes should be compatible and stable in contact with the attenuation fluid (for example, the attenuation fluid should not dissolve or oxidize the conductor material forming a charging electrode).

The displacing electrode 26 is configured to hold an electrical charge that displaces the attenuation fluid 20 from at least a portion of the gap 16 by electrostatic force induced between the displacing electrode 26 and the electrically charged attenuation fluid 20 (which is charged by the charging electrode 18). The displacing electrode 26 can comprise a metallic conductor such as, for example, copper, silver, gold, nickel, palladium, platinum, chromium, molybdenum, tungsten, aluminum, or carbon (including metallic alloys comprising one or more of the listed metallic elements), or combinations of any thereof. The displacing electrode 26 can comprise a thin-film electrode located on the surface 24 of the second substrate 14 facing the gap 16. Displacing electrodes comprising thin-film electrodes can be formed, for example, by depositing and curing conductive inks onto the substrates. Displacing electrodes comprising thin-film electrodes can also be formed, for example, using a chemical vapor deposition or physical vapor deposition technique with appropriate masking to form the electrode pattern on the substrate.

Although not shown in FIG. 1A, an apparatus for providing a variable aperture to control electromagnetic radiation can further comprise an insulating layer located between the conductive material of the displacing electrode(s) and the attenuation fluid. An insulating layer can prevent the flow of electrical charge between a displacing electrode and the attenuation fluid while maintaining respective charge states that induce electrostatic force between the displacing electrode and the attenuation fluid to displace the attenuation fluid in the gap between the substrates. The displacing electrodes and any optional insulating layers should comprise materials of construction that are relatively transparent to the subject electromagnetic radiation (e.g., X-rays having a wavelength in the range of 0.01 to 10 nanometers) and do not absorb or otherwise attenuate appreciable amounts of the electromagnetic radiation.

Figure 2A:
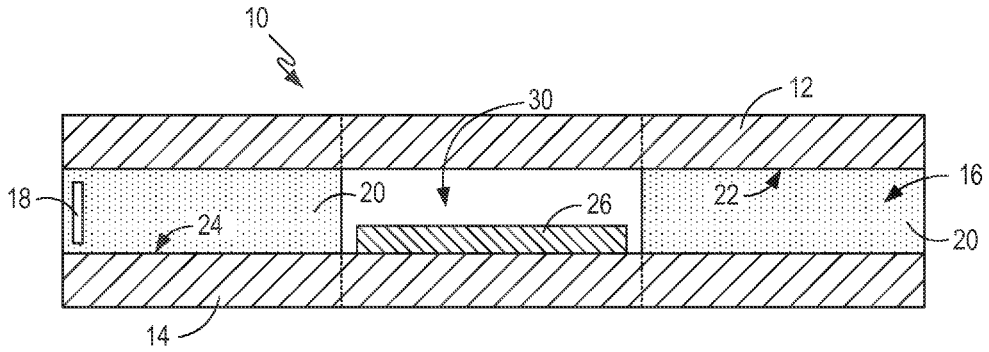
FIG. 2A is a cross-sectional schematic diagram of the apparatus shown in FIG. 1A with the attenuation fluid displaced from a portion of the gap by electrostatic force between the attenuation fluid and the displacing electrode to form an open aperture through the attenuation fluid.
Figure 2B:
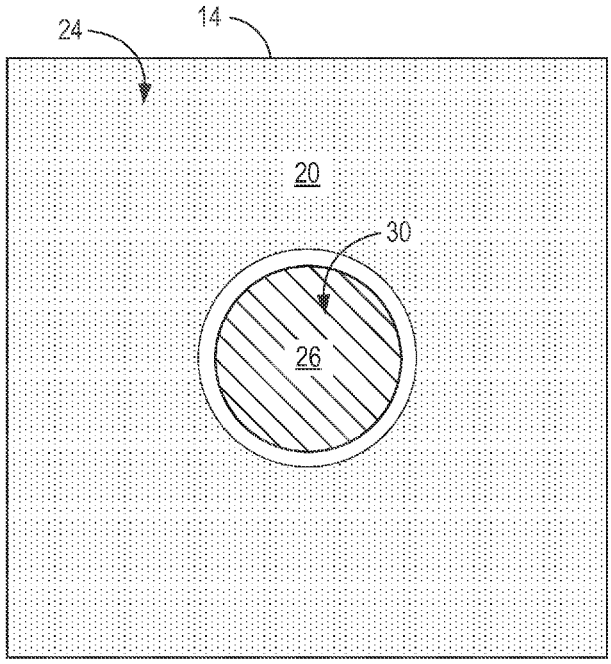
FIG. 2B is a top view schematic diagram of the second substrate, the displacing electrode, and attenuation fluid shown in FIG. 2A.

As shown in FIG. 1A, the attenuation fluid 20 forms a fluid layer in contact with the surface 22 of the first substrate 12 facing the gap 16 and with the surface 24 of the second substrate 14 facing the gap 16. Referring to FIGS. 2A and 2B, electrostatic force between the displacing electrode 26 and the attenuation fluid 20 displaces the attenuation fluid 20 in the gap 16, which provides an open aperture 30 in the layer of attenuation fluid 20. The respective charge states of the displacing electrode 26 and the attenuation fluid 20 can be controlled to change the location, size, and/or shape of the open aperture 30 in the layer of attenuation fluid 20, thus providing a dynamically variable aperture to control electromagnetic radiation. Electromagnetic radiation such as X-rays, for example, can be propagated through the open aperture 30 in the attenuation fluid 20 to form a controlled electromagnetic radiation beam. The location, size, and/or shape of the electromagnetic radiation beam can be controlled by changing the location, size, and/or shape of the open aperture 30 in the layer of attenuation fluid 20, which can be controlled by controlling the respective charge states of the displacing electrode 26 and the attenuation fluid 20.

Figure 3:
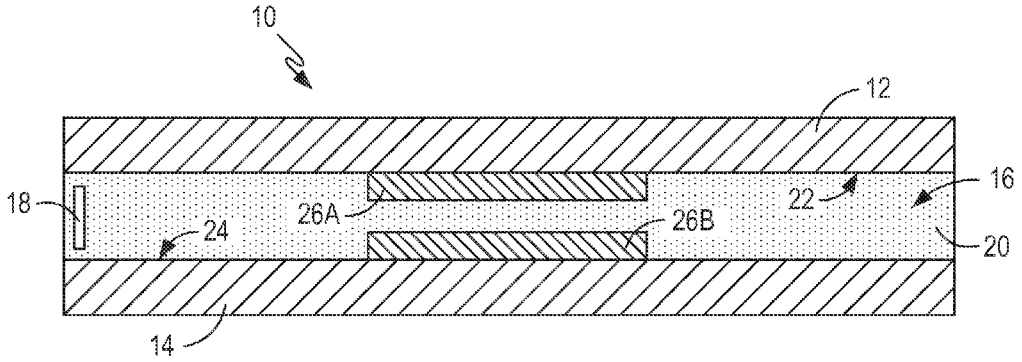
FIG. 3 is a cross-sectional schematic diagram of an apparatus for providing a variable aperture to control electromagnetic radiation, the apparatus comprising first and second opposed substrates, an attenuation fluid located in a gap between the first and second opposed substrates, a charging electrode, and two displacing electrodes.
Figure 4:
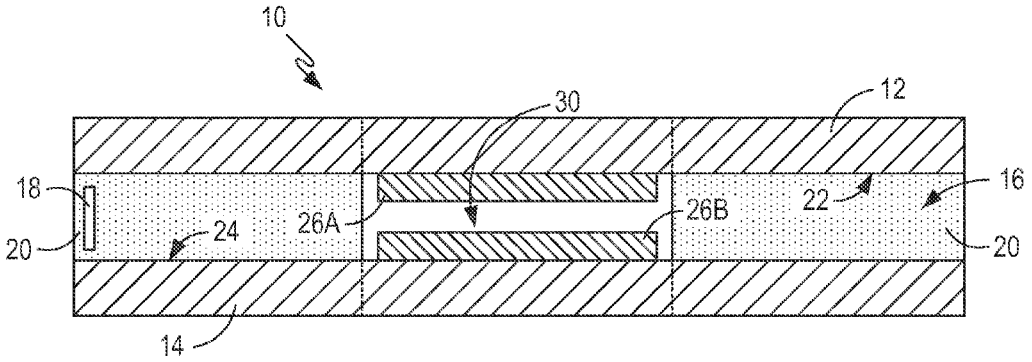
FIG. 4 is a cross-sectional schematic diagram of the apparatus shown in FIG. 3 with the attenuation fluid displaced from a portion of the gap by electrostatic force between the attenuation fluid and the displacing electrodes to form an open aperture through the attenuation fluid.

The displacing electrode 26 is shown in FIGS. 1A and 2A located on the surface 24 of the second substrate 14 facing the gap 16. However, an apparatus for providing a variable aperture to control electromagnetic radiation can comprise at least two displacing electrodes. For example, referring to FIGS. 3 and 4, a first displacing electrode 26A is located on the surface 22 of the first substrate 12 facing the gap 16, and a second displacing electrode 26B is located on the surface 24 of the second substrate 14 facing the gap 16. Electrostatic force between the attenuation fluid 20 and the displacing electrodes 26A and 26B displaces the attenuation fluid 20 in the gap 16, which provides an open aperture 30 in the layer of attenuation fluid 20.

Figure 5:
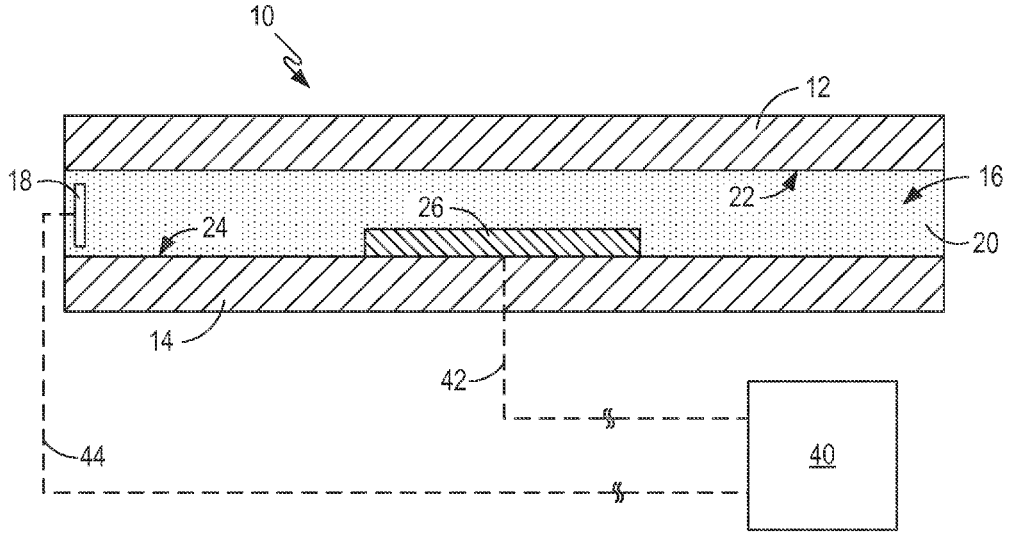
FIG. 5 is a cross-sectional schematic diagram of the apparatus shown in FIG. 1A with the charging electrode and the displacing electrode operably coupled to a controller.
Figure 6:
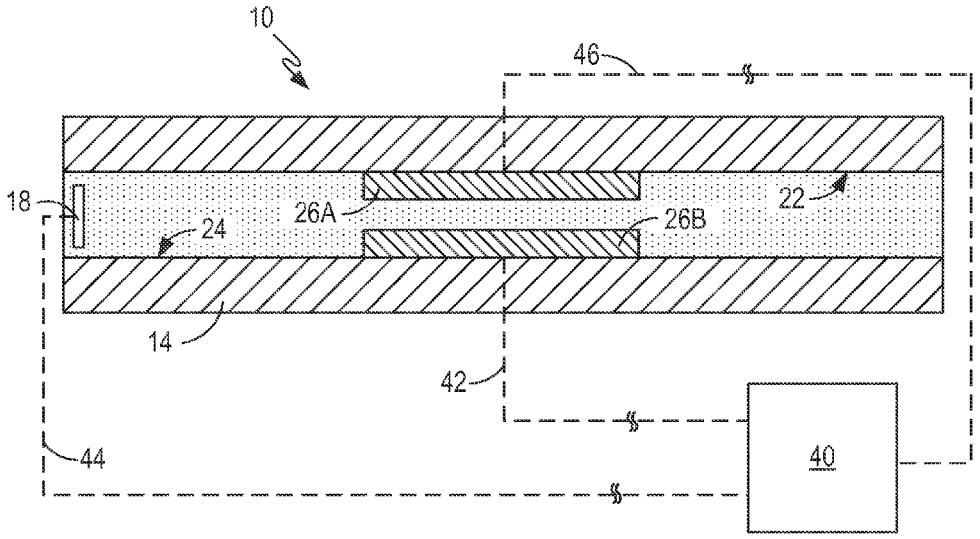
FIG. 6 is a cross-sectional schematic diagram of the apparatus shown in FIG. 3 with the charging electrode and the displacing electrodes operably coupled to a controller.

An apparatus for providing a variable aperture to control electromagnetic radiation can further comprise a controller operably coupled to the charging electrode(s) and/or the displacing electrode(s). Referring to FIGS. 5 and 6, for example, charging electrode 18 is operably coupled to a controller 40 through electrical connection 44. Similarly, displacing electrodes 26 and 26B are operably coupled to the controller 40 through electrical connection 42, and displacing electrode 26A is operably coupled to the controller 40 through electrical connection 46. The controller 40 is configured to control the respective electrical charge states of the displacing electrodes 26/26A/26B and the attenuation fluid 20. For example, the controller 40 is configured to provide an electrical charge to the charging electrode 18 and the displacing electrodes 26/26A/26B. The charging electrode 18, under control of the controller 40, electrically charges the attenuation fluid 20 by transferring electrical charge to the attenuation fluid. The displacing electrodes 26/26A/26B, under control of the controller 40, are electrically charged to induce electrostatic force between the displacing electrodes 26/26A/26B and the electrically charged attenuation fluid 20. The electrically charged attenuation fluid 20 is displaced from at least a portion of the gap 16 by the electrostatic force induced between the electrically charged attenuation fluid 20 and the electrically charged displacing electrodes 26/26A/26B.

By controlling the electrical charge states of displacing electrodes and attenuation fluid, a controller can dynamically vary the location, size, and/or shape of an open aperture through an attenuation fluid layer, thus dynamically controlling the location, size, and/or shape of an electromagnetic radiation beam propagating through the open aperture in the attenuation fluid layer. In this manner, a controller is configured to provide an electrical charge to displacing electrodes to induce electrostatic force and displace charged attenuation fluid. For example, the polarity and magnitude of the electrical charge provided to the displacing electrodes and the attenuation fluid can be independently controlled to induce electrostatic attraction and/or repulsion between the attenuation fluid and the independently controlled displacing electrodes.

FIGS. 1A-6 show zero or one displacing electrode per substrate surface facing the gap formed by the opposed and spaced apart substrates. However, an apparatus for providing a variable aperture to control electromagnetic radiation can comprise two or more displacing electrodes located on any substrate surface facing the gap formed by the opposed and spaced apart substrates (including two or more displacing electrodes located on one substrate surface, or two or more displacing electrodes located on both substrate surfaces, facing the gap formed by the opposed and spaced apart substrates). For example, referring to FIGS. 7A and 7B, an apparatus 60 for providing a variable aperture to control electromagnetic radiation comprises a first substrate 62 and a second substrate 64. The second substrate 64 is located opposite the first substrate 62 and is spaced apart from the first substrate 62 to form a gap 66 between the first substrate 62 and the second substrate 64. An attenuation fluid 70 is located in the gap 66 between the first substrate 62 and the second substrate 64. A charging electrode 68 is in electrical contact with the attenuation fluid 70. A plurality of displacing electrodes 76A, 77A, and 79A are located on a surface 72 of the first substrate 62 facing the gap 66. A plurality of displacing electrodes 76B, 77B, and 79B are located on a surface 74 of the second substrate 64 facing the gap 66.

Figure 7A:
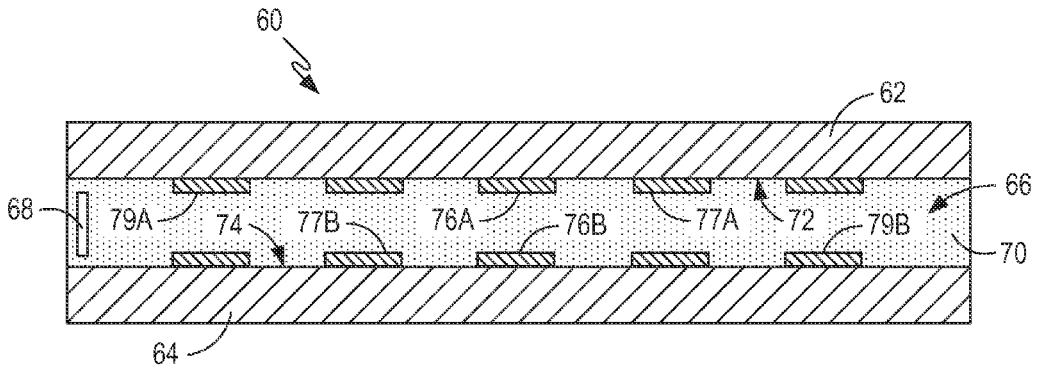
FIG. 7A is a cross-sectional schematic diagram of an apparatus for providing a variable aperture to control electromagnetic radiation, the apparatus comprising first and second opposed substrates, an attenuation fluid located in a gap between the first and second opposed substrates, a charging electrode, and a series of displacing electrodes.
Figure 7B:
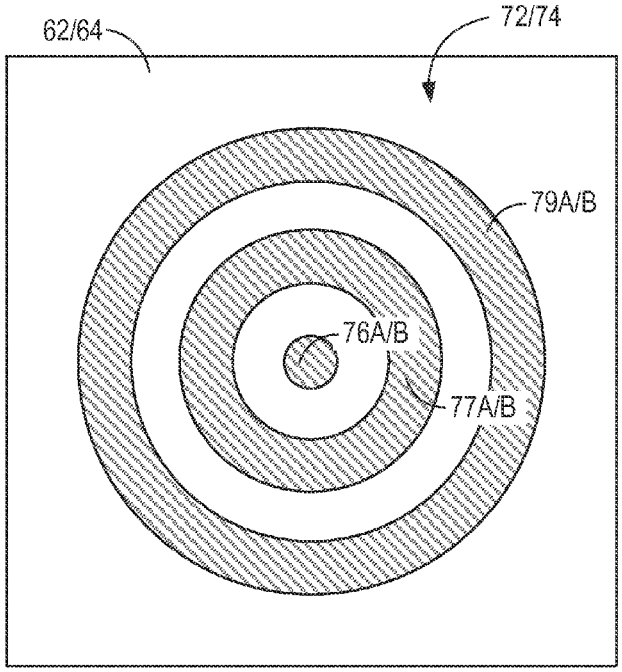
FIG. 7B is a top view schematic diagram of the first or second substrate and the displacing electrodes shown in FIG. 7A.

As shown in FIG. 7B, the displacing electrodes 77A, 79A, 77B, and 79B comprise an annular shape and are arranged concentrically around displacing electrodes 76A and 76B, respectively, on the respective substrate surfaces 72 and 74. FIGS. 7A and 7B show two annular-shaped and concentrically-arranged displacing electrodes located on each substrate surface facing the gap formed by the opposed and spaced apart substrates. However, an apparatus for providing a variable aperture to control electromagnetic radiation can comprise any number of annular-shaped and concentrically-arranged displacing electrodes located on the gap-facing surfaces of one or both of the opposed and spaced apart substrates. FIGS. 7A and 7B also show a circular-shaped displacing electrode located on each substrate surface facing the gap formed by the opposed and spaced apart substrates. However, an apparatus for providing a variable aperture to control electromagnetic radiation can omit the circular-shaped displacing electrode, and thus comprise a circular-shaped area without a displacing electrode located at the center of a concentric array of annular-shaped displacing electrodes.

The displacing electrodes shown in FIGS. 7A and 7B are circular-shaped and annular-shaped. However, an apparatus for providing a variable aperture to control electromagnetic radiation can comprise displacing electrodes comprising other shapes such as, for example, ellipse, triangle, Reuleaux triangle, square, rectangle, rhombus (diamond), hexagon, or octagon (including both closed-shaped (e.g., elliptical-shaped) and open-shaped (e.g., elliptical annulus-shaped) electrodes).

Figure 8A:
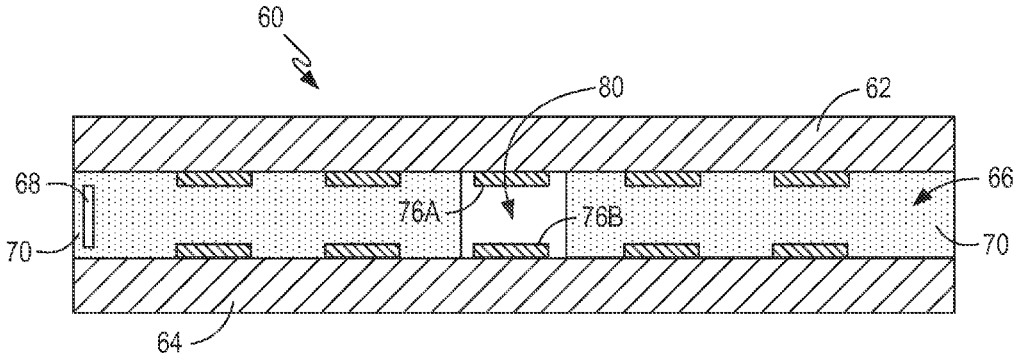
FIG. 8A is a cross-sectional schematic diagram of the apparatus shown in FIG. 7A with the attenuation fluid displaced from a portion of the gap by electrostatic force between the attenuation fluid and the displacing electrodes to form an open aperture through the attenuation fluid.
Figure 8B:
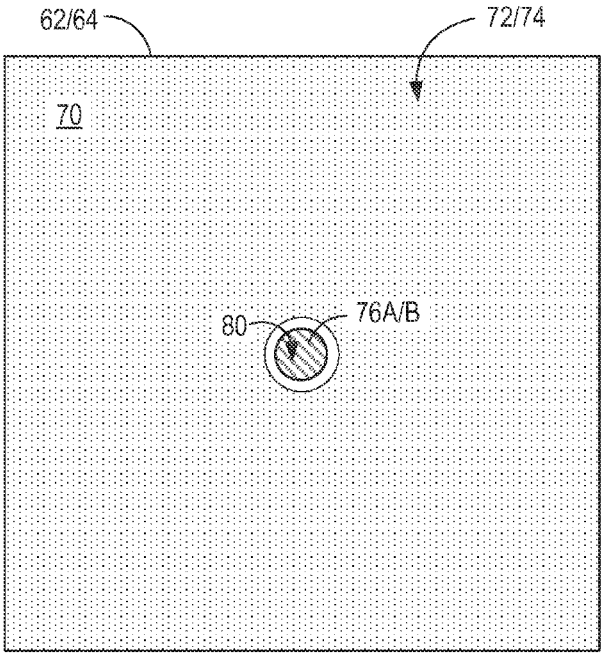
FIG. 8B is a top view schematic diagram of the first or second substrate, the displacing electrodes, and attenuation fluid shown in FIG. 8A.
Figure 9A:
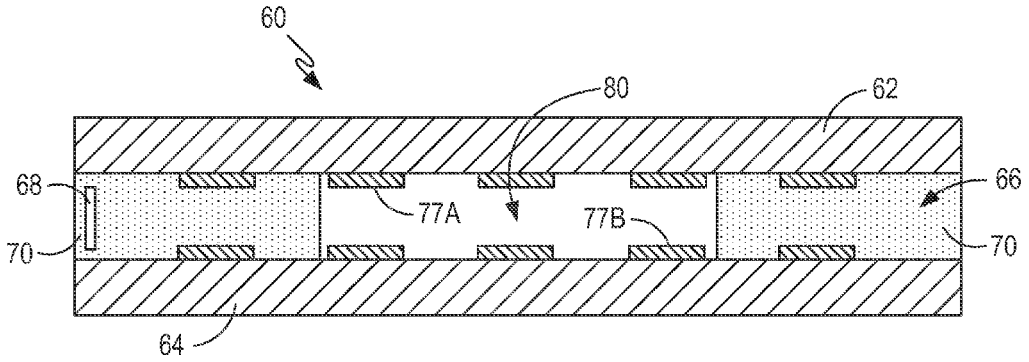
FIG. 9A is a cross-sectional schematic diagram of the apparatus shown in FIG. 8A with the attenuation fluid further displaced from a portion of the gap by electrostatic force between the attenuation fluid and the displacing electrodes to form a larger open aperture through the attenuation fluid.
Figure 9B:
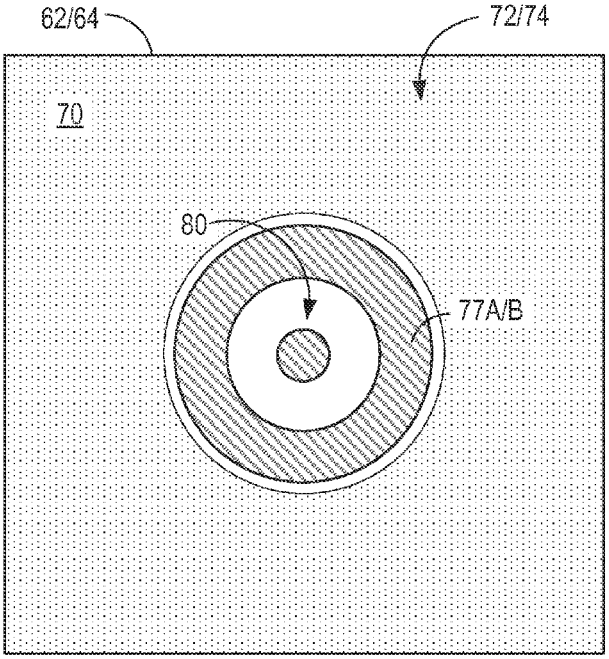
FIG. 9B is a top view schematic diagram of the first or second substrate, the displacing electrodes, and attenuation fluid shown in FIG. 9A.
Figure 10A:
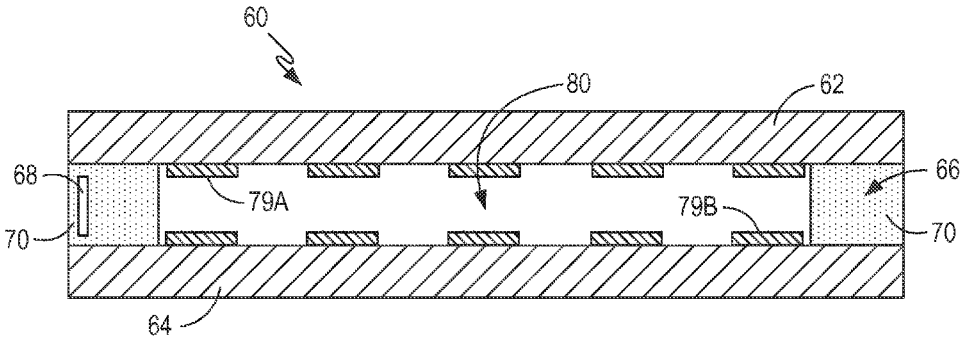
FIG. 10A is a cross-sectional schematic diagram of the apparatus shown in FIG. 9A with the attenuation fluid further displaced from a portion of the gap by electrostatic force between the attenuation fluid and the displacing electrodes to form a larger open aperture through the attenuation fluid.
Figure 10B:
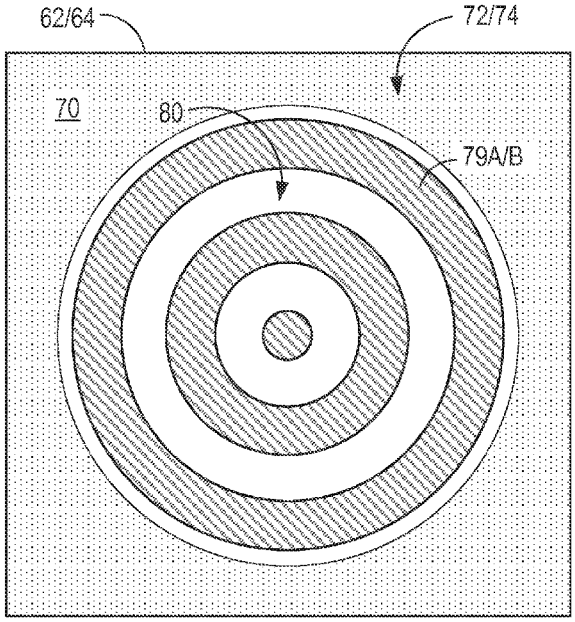
FIG. 10B is a top view schematic diagram of the first or second substrate, the displacing electrodes, and attenuation fluid shown in FIG. 10A.

Referring to FIGS. 8A and 8B, electrostatic force between the attenuation fluid 70 and the displacing electrodes 76A and 76B displaces the attenuation fluid 70 in the gap 66, which provides an open aperture 80 in the layer of attenuation fluid 70. The respective charge states of the displacing electrodes 76A/B and the attenuation fluid 20 can be controlled by a controller (not shown) to change the location, size, and/or shape of the open aperture 80 in the layer of attenuation fluid 70, thus providing a variable aperture to control electromagnetic radiation. For example, as shown in FIGS. 9A and 9B, electrostatic force between the attenuation fluid 70 and the displacing electrodes 76A/B and 77A/B further displaces the attenuation fluid in the gap 66, which increases the size of the open aperture 80 in the layer of attenuation fluid 70. As further shown in FIGS. 10A and 10B, electrostatic force between the attenuation fluid 70 and the displacing electrodes 76A/B, 77A/B, and 79A/B further displaces the attenuation fluid in the gap 66, which further increases the size of the open aperture 80 in the layer of attenuation fluid 70.

Electromagnetic radiation such as X-rays, for example, can propagate through the open aperture 80 in the attenuation fluid 70 to form a controlled (e.g., collimated) electromagnetic radiation beam. The location, size, and/or shape of the electromagnetic radiation beam can be controlled by changing the location, size, and/or shape of the open aperture 80 in the layer of attenuation fluid 70, which can be controlled by controlling the respective charge states of the attenuation fluid 70 and the displacing electrodes 76A/B, 77A/B, and 79A/B.

Figure 11:
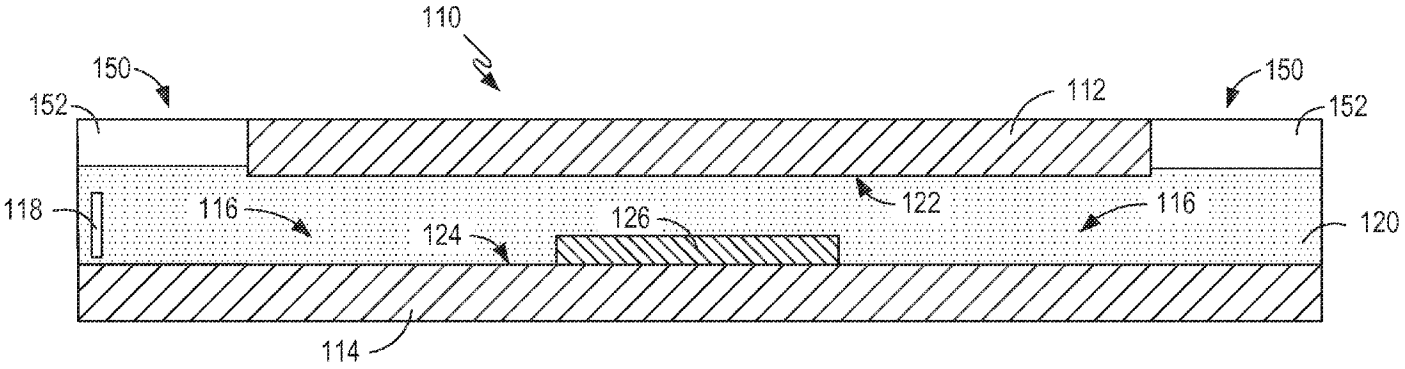
FIG. 11 is a cross-sectional schematic diagram of an apparatus for providing a variable aperture to control electromagnetic radiation, the apparatus comprising first and second opposed substrates, an attenuation fluid located in a gap between the first and second opposed substrates, a charging electrode, a displacing electrode, and a fluid reservoir.
Figure 12:
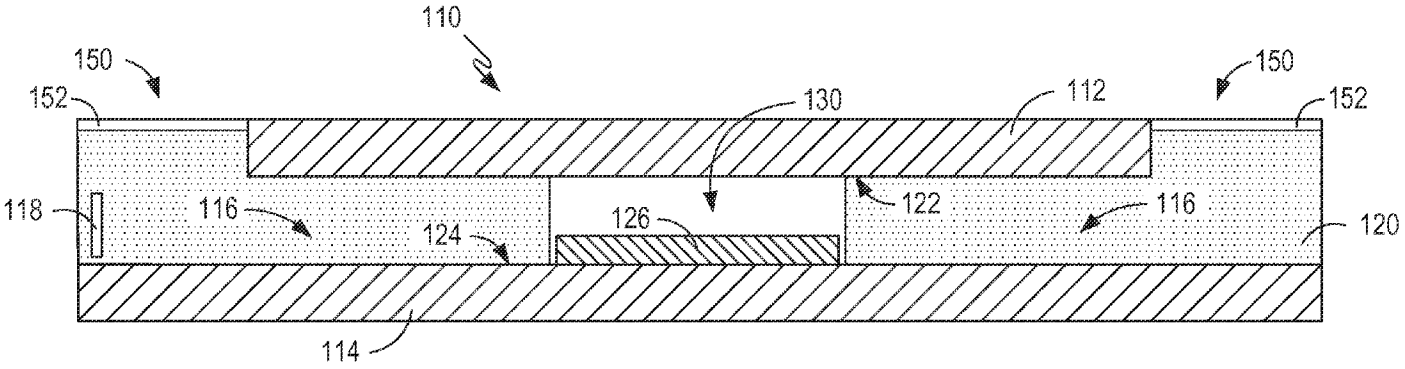
FIG. 12 is a cross-sectional schematic diagram of the apparatus shown in FIG. 11 with the attenuation fluid displaced from a portion of the gap and into the fluid reservoir by electrostatic force between the attenuation fluid and the displacing electrode to form an open aperture through the attenuation fluid.
Figure 13:
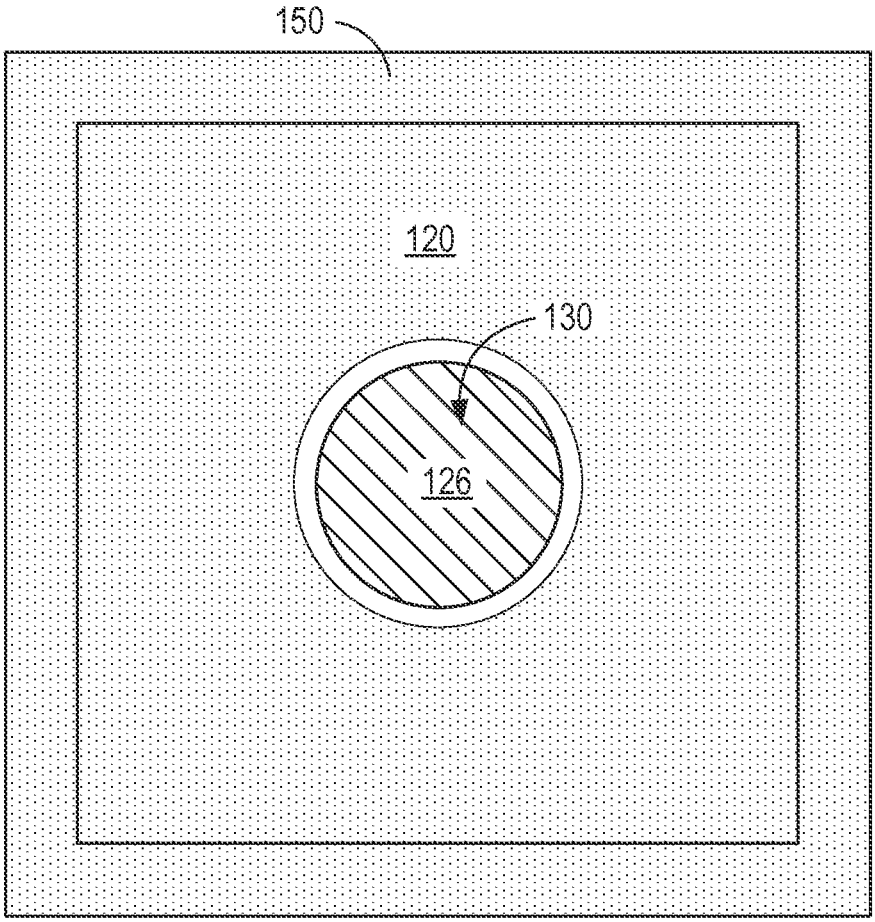
FIG. 13 is a top view schematic diagram of the second substrate, the displacing electrode, the attenuation fluid, and the fluid reservoir shown in FIG. 12.

An apparatus for providing a variable aperture to control electromagnetic radiation can further comprise a fluid reservoir in fluid communication with the attenuation fluid located in the gap between the first substrate and the second substrate. Referring to FIGS. 11, 12, and 13, for example, an apparatus 110 for providing a variable aperture to control electromagnetic radiation comprises a first substrate 112 and a second substrate 114. The second substrate 114 is located opposite the first substrate 112 and is spaced apart from the first substrate 112 to form a gap 116 between the first substrate 112 and the second substrate 114. An attenuation fluid 120 is located in the gap 116 between the first substrate 112 and the second substrate 114. A charging electrode 118 is in electrical contact with the attenuation fluid 120. A displacing electrode 126 is located on a surface 124 of the second substrate 114 facing the gap 116 (and although not shown in FIGS. 11-13, the displacing electrode 126 can alternatively be located on a surface 122 of the first substrate 112 facing the gap 116, or a second displacing electrode can additionally be located on the surface 122 of the first substrate 112, or a plurality of displacing electrodes can be positioned on the first and/or second surfaces of the respective substrates, as described above).

Still referring to FIGS. 11, 12, and 13, the apparatus 110 comprises fluid reservoir 150 in fluid communication with the attenuation fluid 120 located in the gap 116 between the first substrate 112 and the second substrate 114. The fluid reservoir 150 comprises a chamber located along the perimeter of the gap 116 between the first substrate 112 and the second substrate 114. The charging electrode 118 is located in the fluid reservoir 150 and electrically contacts the attenuation fluid 120 in the fluid reservoir, which is in fluid communication with and therefore electrically connected to the attenuation fluid in the gap 116. The fluid reservoir 150 is configured to receive and releasably hold the attenuation fluid 120 displaced from at least a portion of the gap 116 by the electrostatic force between the displacing electrode 126 and the attenuation fluid 120. As shown in FIG. 11, when there is no open aperture in the layer of attenuation fluid 120, the fluid reservoir 150 has the capacity to absorb and hold additional attenuation fluid 120 in the open volume 152. As shown in FIG. 12, when the displacing electrode 126 is electrically charged (for example, under the control of a controller, not shown), and the induced electrostatic force displaces the charged attenuation fluid 120 from a portion of the gap 116 and forms an open aperture 130 through the layer of attenuation fluid 120, the displaced attenuation fluid 120 flows into and is absorbed by the fluid reservoir 150, thus decreasing the open volume 152. When the displacing electrode 126 is deactivated (for example, under the control of a controller, not shown), and the electrostatic force removed, the displaced attenuation fluid flows back from the fluid reservoir and into the gap 116, thus reducing the size and/or changing the shape of the open aperture 130 through the layer of attenuation fluid 120 in the gap 116. The attenuation fluid 120 is sealed within the gap 116 and the fluid reservoir 150 to prevent loss of fluid from the system during displacement or otherwise.

Figure 14:
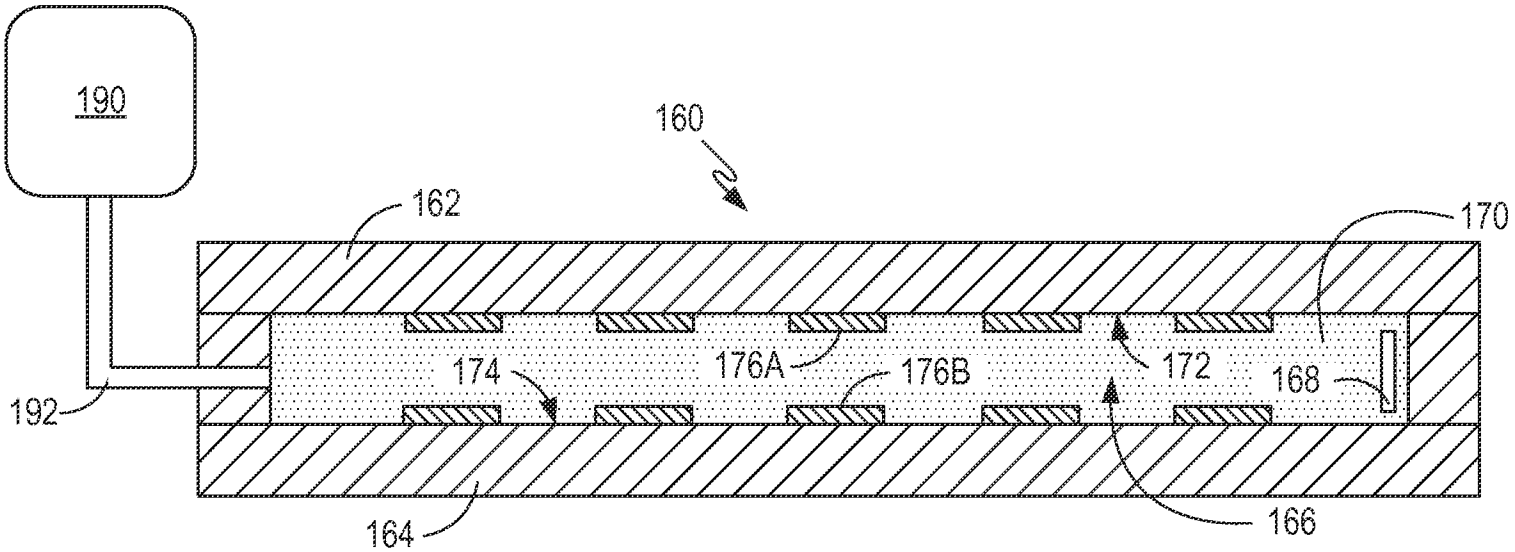
FIG. 14 is a cross-sectional schematic diagram of an apparatus for providing a variable aperture to control electromagnetic radiation, the apparatus comprising first and second opposed substrates, an attenuation fluid located in a gap between the first and second opposed substrates, a charging electrode, a series of displacing electrodes, and a fluid reservoir.
Figure 15:
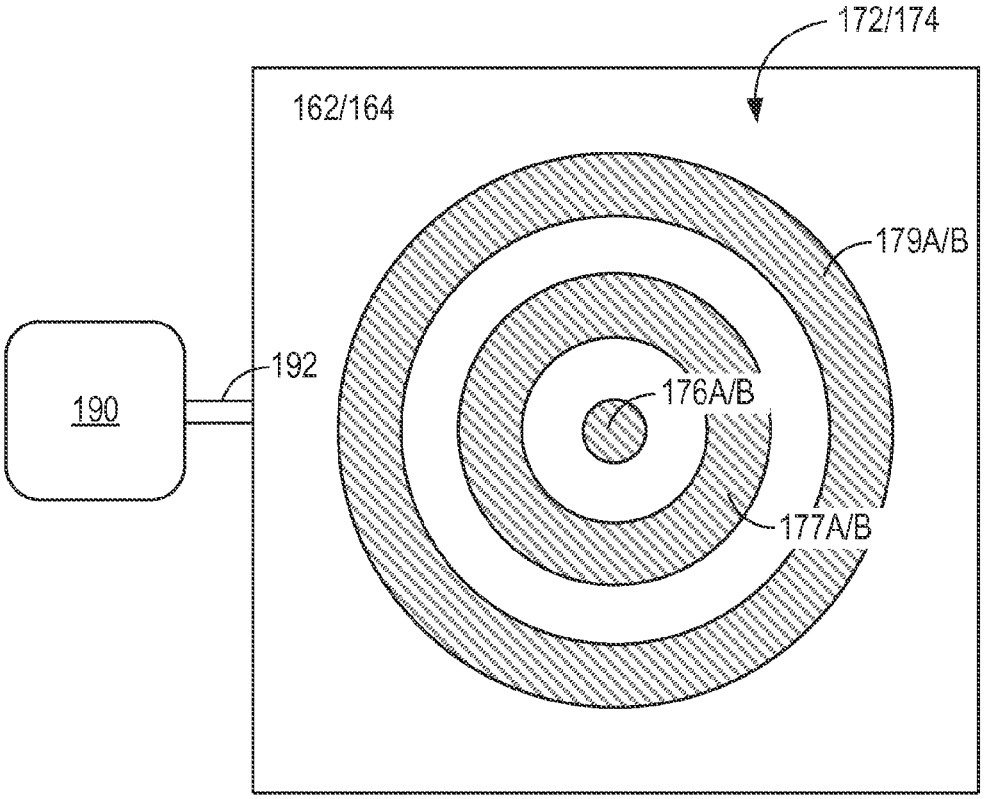
FIG. 15 is a top view schematic diagram of the first or second substrate, the displacing electrodes, and the fluid reservoir shown in FIG. 14.

Referring to FIGS. 14 and 15, an apparatus 160 for providing a variable aperture to control electromagnetic radiation comprises a first substrate 162 and a second substrate 164. The second substrate 164 is located opposite the first substrate 162 and is spaced apart from the first substrate 162 to form a gap 166 between the first substrate 162 and the second substrate 164. An attenuation fluid 170 is located in the gap 166 between the first substrate 162 and the second substrate 164. A charging electrode 168 is in electrical contact with the attenuation fluid 170. A plurality of displacing electrodes 176A, 177A, and 179A are located on a surface 172 of the first substrate 162 facing the gap 166. A plurality of displacing electrodes 176B, 177B, and 179B are located on a surface 174 of the second substrate 164 facing the gap 166.

The apparatus 160 comprises a fluid reservoir 190 in fluid communication with the attenuation fluid 170 located in the gap 166 between the first substrate 162 and the second substrate 164. The fluid reservoir 190 is physically separated from the substrates 162 and 164, and fluid conduit 192 connects the fluid reservoir 190 to the volume formed by the gap 166 between the first substrate 162 and the second substrate 164. The fluid conduit 192 thus provides the fluid communication between the fluid reservoir 190 and the attenuation fluid 170 located in the gap 166.

The fluid reservoir 190 is configured to releasably hold the attenuation fluid 170 displaced from at least a portion of the gap 166 by the electrostatic force between the attenuation fluid 170 and the displacing electrodes 176A/B, 177A/B, and 179A/B. When there is no open aperture in the layer of attenuation fluid 170, the fluid reservoir 190 has the capacity to absorb and hold additional attenuation fluid 170. When the displacing electrodes 176A/B, 177A/B, and 179A/B are electrically charged (for example, under the control of a controller, not shown), and the induced electrostatic force displaces the charged attenuation fluid 170 from a portion of the gap 166, the displaced attenuation fluid 170 flows through the fluid conduit 192 and is absorbed by the fluid reservoir 190. When one or more of the displacing electrodes 176A/B, 177A/B, and 179A/B are deactivated (for example, under the control of a controller, not shown), and the electrostatic force removed, the displaced attenuation fluid flows back through the fluid conduit 192 and into the gap 166, thus reducing the size and/or changing the shape of the open aperture through the layer of attenuation fluid 170 in the gap 166. The attenuation fluid 170 is sealed within the gap 166, the fluid reservoir 190, and the fluid conduit 192 to prevent loss of fluid from the system during displacement or otherwise.

The displacing electrodes illustrated in FIGS. 1A-15 are shown deposited on the gap-facing surface of one or both of the constituent substrates comprising the apparatus. However, the displacing electrodes can be embedded in the gap-facing surface of one or both of the constituent substrates comprising the apparatus.

Figure 16:
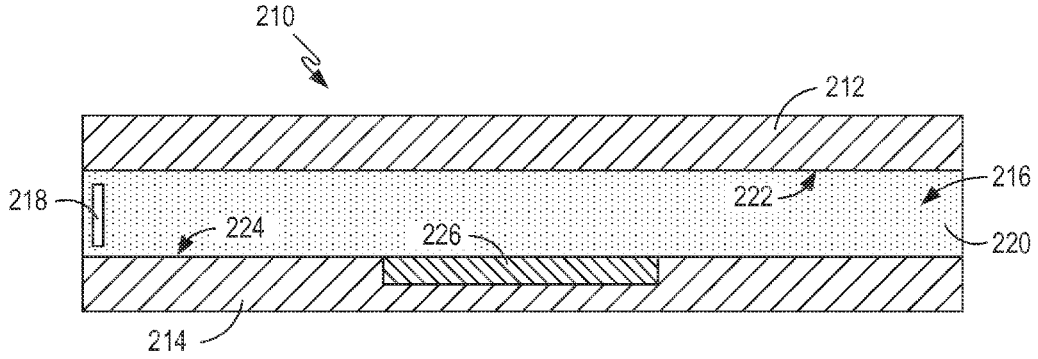
FIG. 16 is a cross-sectional schematic diagram of an apparatus for providing a variable aperture to control electromagnetic radiation, the apparatus comprising first and second opposed substrates, an attenuation fluid located in a gap between the first and second opposed substrates, a charging electrode, and a displacing electrode.

For example, referring to FIG. 16, an apparatus 210 for providing a variable aperture to control electromagnetic radiation comprises a first substrate 212 and a second substrate 214. The second substrate 214 is located opposite the first substrate 212 and is spaced apart from the first substrate 212 to form a gap 216 between the first substrate 212 and the second substrate 214. An attenuation fluid 220 is located in the gap 216 between the first substrate 212 and the second substrate 214. A charging electrode 218 is in electrical contact with the attenuation fluid 220. A displacing electrode 226 is located on and embedded in a surface 224 of the second substrate 214 facing the gap 216. Although not shown in FIG. 16, the apparatus 210 can comprise a controller and a fluid reservoir, as described above.

Figure 17:
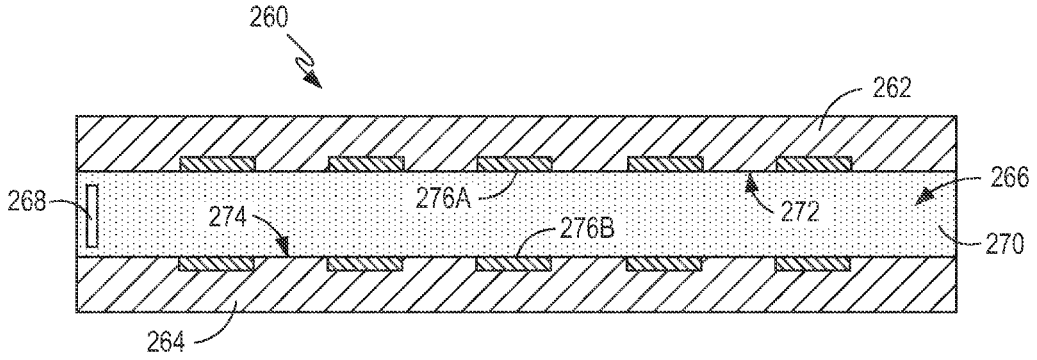
FIG. 17 is a cross-sectional schematic diagram of an apparatus for providing a variable aperture to control electromagnetic radiation, the apparatus comprising first and second opposed substrates, an attenuation fluid located in a gap between the first and second opposed substrates, a charging electrode, and a series of displacing electrodes.

Similarly, referring to FIG. 17, an apparatus 260 for providing a variable aperture to control electromagnetic radiation comprises a first substrate 262 and a second substrate 264. The second substrate 264 is located opposite the first substrate 262 and is spaced apart from the first substrate 262 to form a gap 266 between the first substrate 262 and the second substrate 264. An attenuation fluid 270 is located in the gap 266 between the first substrate 262 and the second substrate 264. A charging electrode 268 is in electrical contact with the attenuation fluid 270. A plurality of displacing electrodes, including electrode 276A, are located on and embedded in a surface 272 of the first substrate 262 facing the gap 266. A plurality of displacing electrodes, including electrode 276B, are located on and embedded in a surface 274 of the second substrate 264 facing the gap 266. Although not shown in FIG. 17, the apparatus 210 can comprise a controller and a fluid reservoir, as described above.

Displacing electrodes embedded in the gap-facing surface of a substrate can be produced by etching or machining depressions into the gap-facing surface of a substrate in an electrode pattern, and filling the etched or machined depressions with conductive material such as, for example, the electrode materials described above.

Figure 18:
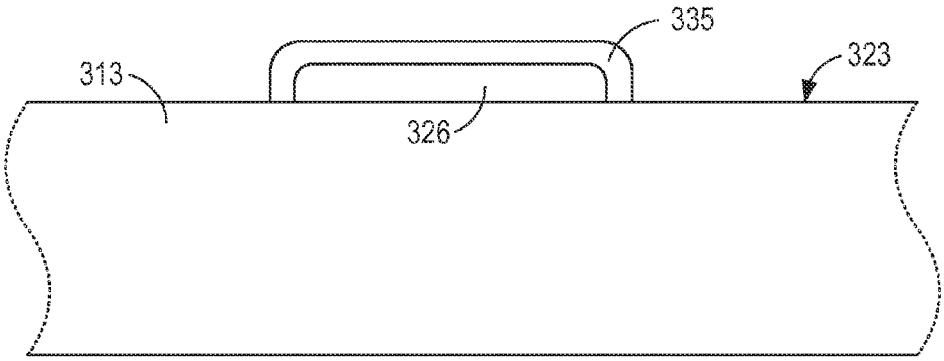
FIG. 18 is a cross-sectional schematic diagram of a substrate having a displacing electrode located on one surface of the substrate and an insulator layer located over the displacing electrode.

As described above, and although not shown in FIGS. 1A-17, an apparatus for providing a variable aperture to control electromagnetic radiation (including the apparatuses shown in FIGS. 1A-17) can comprise an insulator layer located between a displacing electrode and the attenuation fluid. For example, referring to FIG. 18, a substrate 313 has a surface 323 that faces a gap formed by an opposed and spaced apart substrate (not shown). A displacing electrode 326 is located on the surface 323 of the substrate 313. An insulator layer 335 is located over the displacing electrode 326 and forms a non-conductive barrier between the displacing electrode 326 and adjacent attenuation fluid (not shown). The insulator layer 335 can prevent the flow of electrical charge between the displacing electrode 326 and the attenuation fluid, and maintain the separately controlled electrical charge states of the displacing electrode 326 and the adjacent attenuation fluid, and facilitate the electrostatic displacement of the attenuation fluid.

Figure 19:
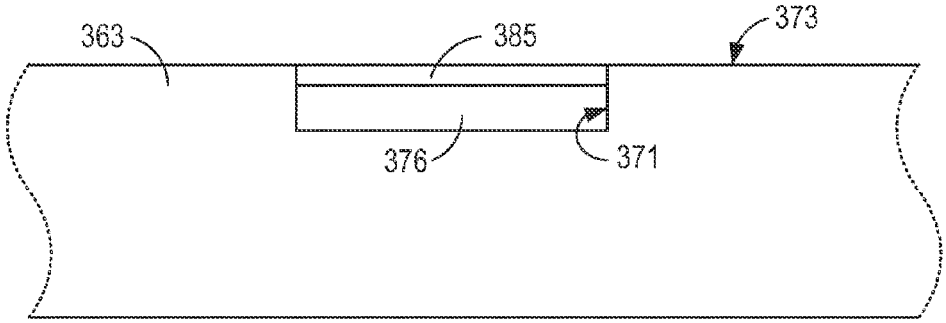
FIG. 19 is a cross-sectional schematic diagram of a substrate having a displacing electrode located on one surface of the substrate and an insulator layer located over the displacing electrode.
Figure 20:
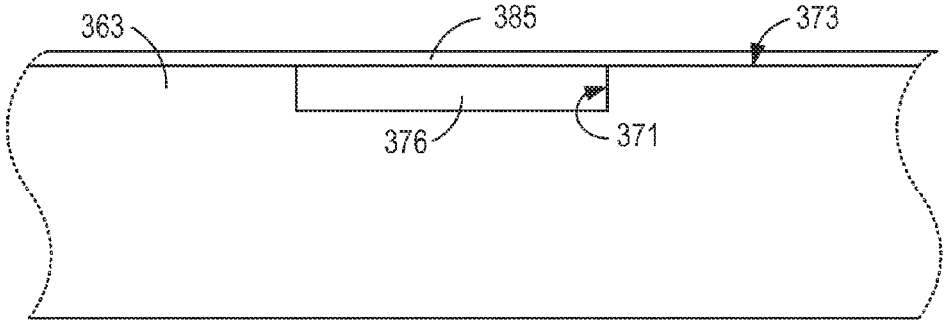
FIG. 20 is a cross-sectional schematic diagram of a substrate having a displacing electrode located on one surface of the substrate and an insulator layer located over the displacing electrode.

Referring to FIGS. 19 and 20, a substrate 363 has a surface 373 that faces a gap formed by an opposed and spaced apart substrate (not shown). A displacing electrode 376 is located on and embedded in the surface 373 of the substrate 363. An insulator layer 385 is located over the displacing electrode 376 and forms a non-conductive barrier between the displacing electrode 376 and adjacent attenuation fluid (not shown). In FIG. 19, the embedded displacing electrode 376 is contained in an underlying portion of a depression 371 in the surface 373, and the insulator layer 385 is contained in an overlying portion of the depression 371. In FIG. 20, the embedded displacing electrode 376 fills the depression 371 in the surface 373, and the insulator layer 385 is located over the entire surface 373 of the substrate 363. The insulator layer 385 can prevent the flow of electrical charge between the displacing electrode 376 and the attenuation fluid (not shown), and maintain the separately controlled electrical charge states of the displacing electrode 326 and the adjacent attenuation fluid, and facilitate the electrostatic displacement of the attenuation fluid.

Insulator layers located between displacing electrodes and attenuation fluid can comprise suitable dielectric or other electrically-insulating materials such as, for example, polymeric coatings (e.g., epoxies, acrylics, polyurethanes/polyureas, polyolefins, fluoropolymers, polysiloxanes, or the like) or ceramic coatings (e.g., silicon dioxide, aluminum oxide, titanium dioxide, or the like). Insulator layers and thin-film displacing electrodes can be deposited using techniques such as screen-printing, lithography, chemical vapor deposition, or physical vapor deposition.

Figure 21:
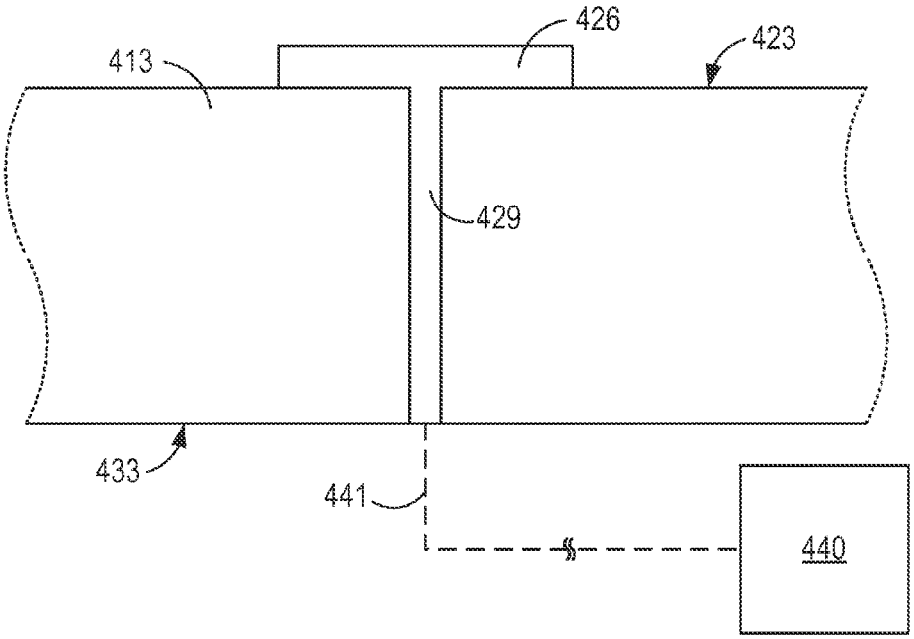
FIG. 21 is a cross-sectional schematic diagram of a substrate having a displacing electrode located on one surface of the substrate and a via located through the substrate, the via operably coupling the displacing electrode to a controller.

Charging electrodes and displacing electrodes can be operably coupled to a controller using electrical connections such as, for example, conductive vias, conductive traces/tracks, wires, and the like. For example, referring to FIG. 21, a substrate 413 has a surface 423 that faces a gap formed by an opposed and spaced apart substrate (not shown). A displacing electrode 426 is located on the surface 423 of the substrate 413. A conductive via 429 is located through the thickness of the substrate 413 and electrically connects the displacing electrode 426 to the opposite surface 433 of the substrate 413. The conductive via 429 is electrically connected to a controller 440 through electrical connection 441, which can be implemented using, for example, conductive traces/tracks, wires, or the like.

Figure 22:
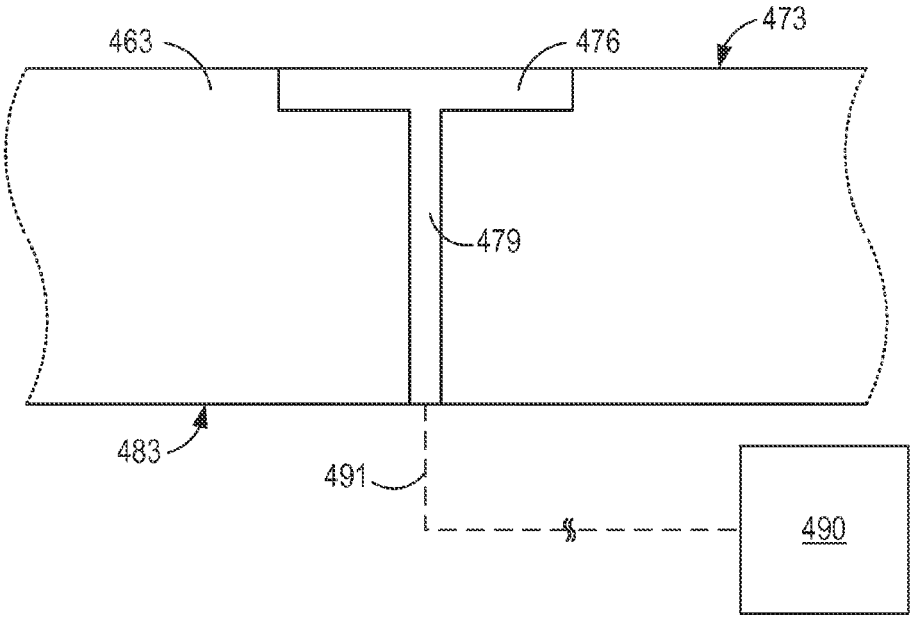
FIG. 22 is a cross-sectional schematic diagram of a substrate having a displacing electrode located on one surface of the substrate and a via located through the substrate, the via operably coupling the displacing electrode to a controller.

Similarly, referring to FIG. 22, a substrate 463 has a surface 473 that faces a gap formed by an opposed and spaced apart substrate (not shown). A displacing electrode 476 is located on and embedded in the surface 473 of the substrate 463. A conductive via 479 is located through the thickness of the substrate 463 and electrically connects the displacing electrode 476 to the opposite surface 483 of the substrate 463. The conductive via 479 is electrically connected to a controller 490 through electrical connection 491, which can be implemented using, for example, conductive traces/tracks, wires, or the like.

Figure 23A:
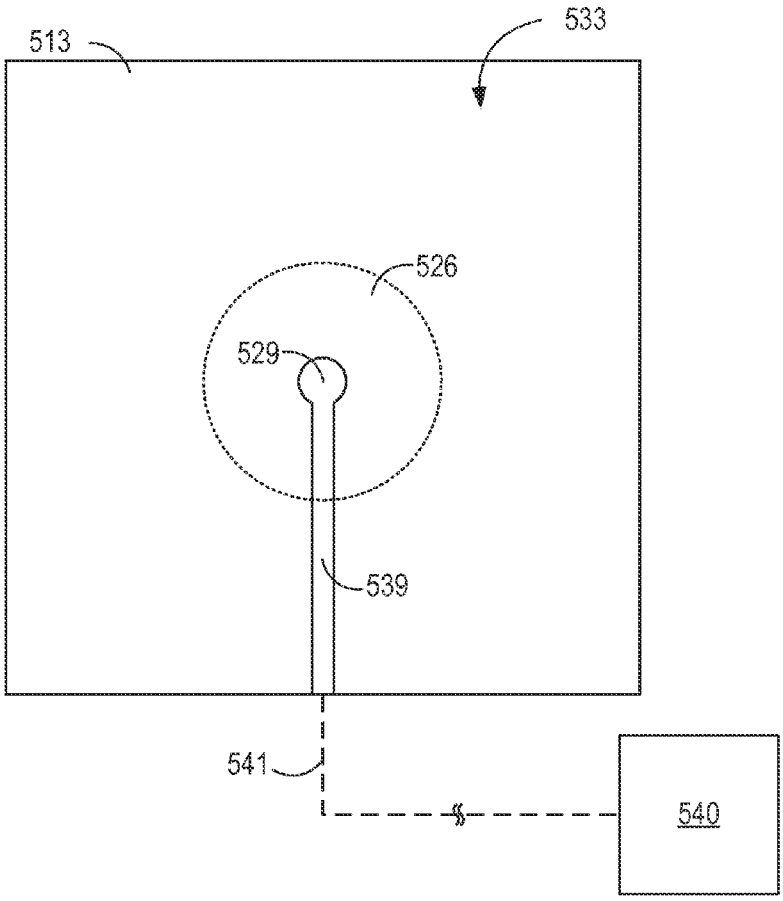
FIG. 23A is a bottom view schematic diagram of a substrate having a displacing electrode located on one surface of the substrate, a via located through the substrate, and a conductive trace/track located on the surface of the substrate opposite the displacing electrode, the via and conductive trace/track operably coupling the displacing electrode to a controller.
Figure 23B:
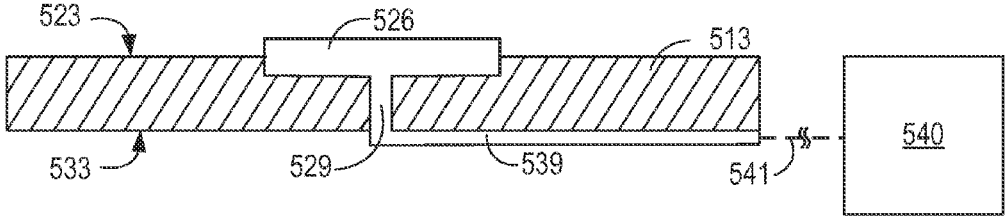
FIG. 23B is a cross-sectional schematic diagram of the substrate shown in FIG. 23A.

For example, displacing electrodes can be operably coupled to a controller with conductive vias and/or conductive traces/tracks located in or on a substrate. Referring to FIGS. 23A and 23B, a substrate 513 has a surface 523 that faces a gap formed by an opposed and spaced apart substrate (not shown). A displacing electrode 526 is located on and partially embedded in the surface 523 of the substrate 513. A conductive via 529 is located through the thickness of the substrate 513 and electrically connects the displacing electrode 526 to the opposite surface 533 of the substrate 513. The conductive via 529 is electrically connected to a controller 540 through conductive trace/track 539 located on the surface 533 of the substrate 513. The conductive trace/track 539 is electrically connected to the controller 540 through electrical connection 541, which can be implemented using, for example, a wire or the like.

The displacing electrodes shown in FIGS. 1A-23B are annular-shaped and/or circular-shaped, and multiple electrodes on a single surface are shown concentrically arranged. However, as described above, an apparatus for providing a variable aperture to control electromagnetic radiation can comprise displacing electrodes comprising other shapes such as, for example, ellipse, triangle, Reuleaux triangle, square, rectangle, rhombus (diamond), hexagon, or octagon (including both closed-shaped (e.g., elliptical-shaped) and open-shaped (e.g., elliptical annulus-shaped) electrodes). A plurality of displacing electrodes can also be arranged in a two-dimensional array on (and optionally embedded or partially embedded in) a substrate.

Figure 24:
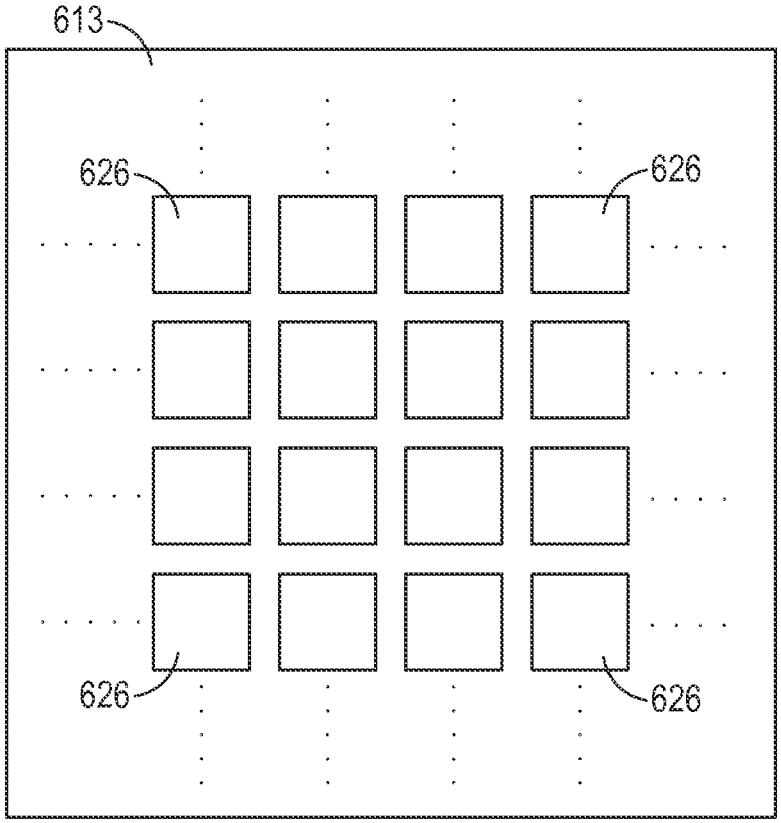
FIG. 24 is a top view schematic diagram of a substrate having an array of square-shaped displacing electrodes.
Figure 25:
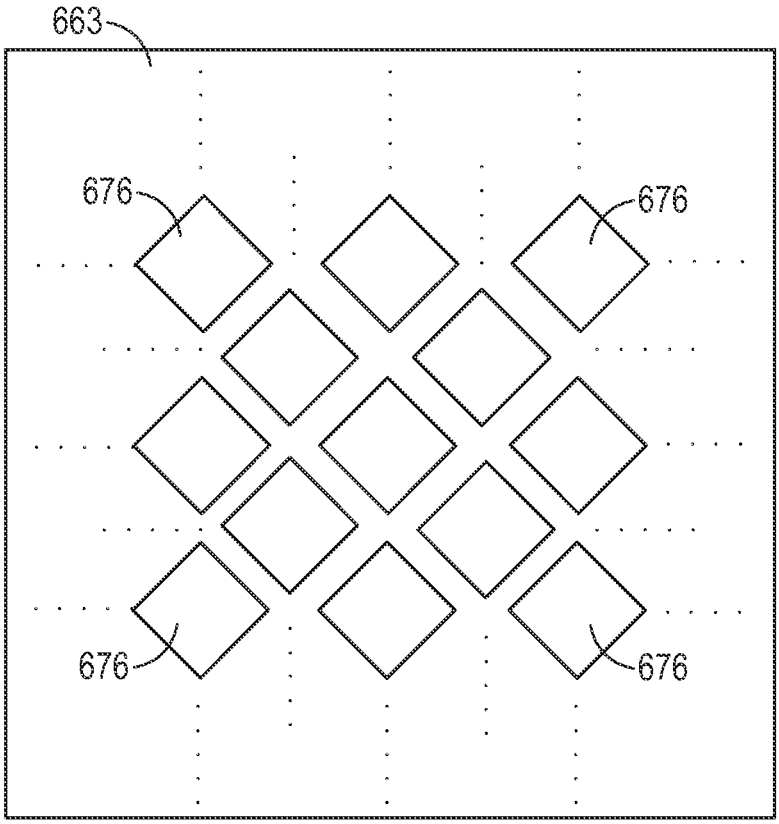
FIG. 25 is a top view schematic diagram of a substrate having an array of diamond-shaped displacing electrodes.
Figure 26:
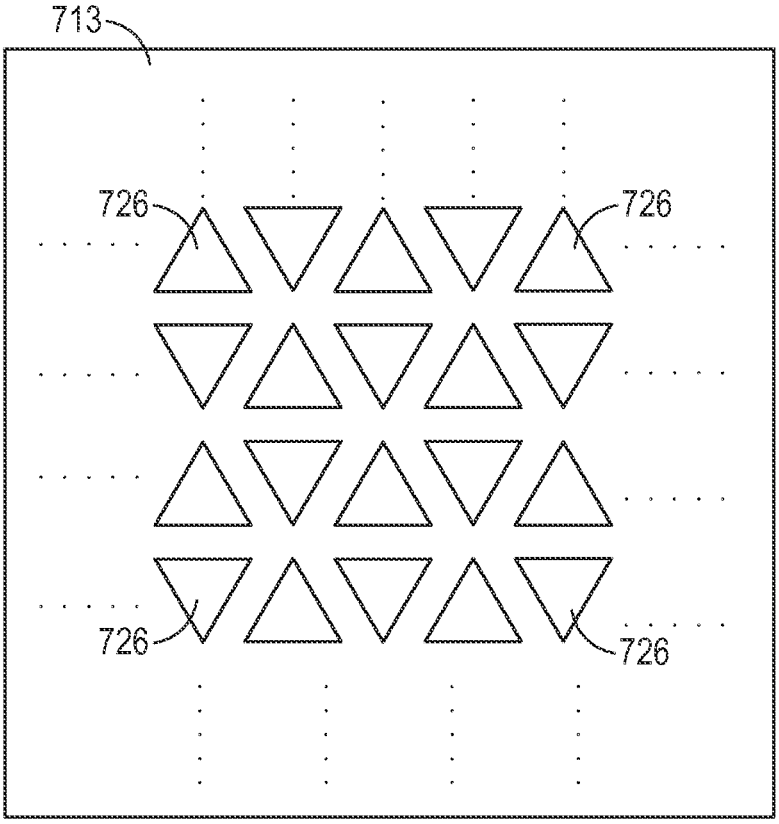
FIG. 26 is a top view schematic diagram of a substrate having an array of triangle-shaped displacing electrodes.
Figure 27:
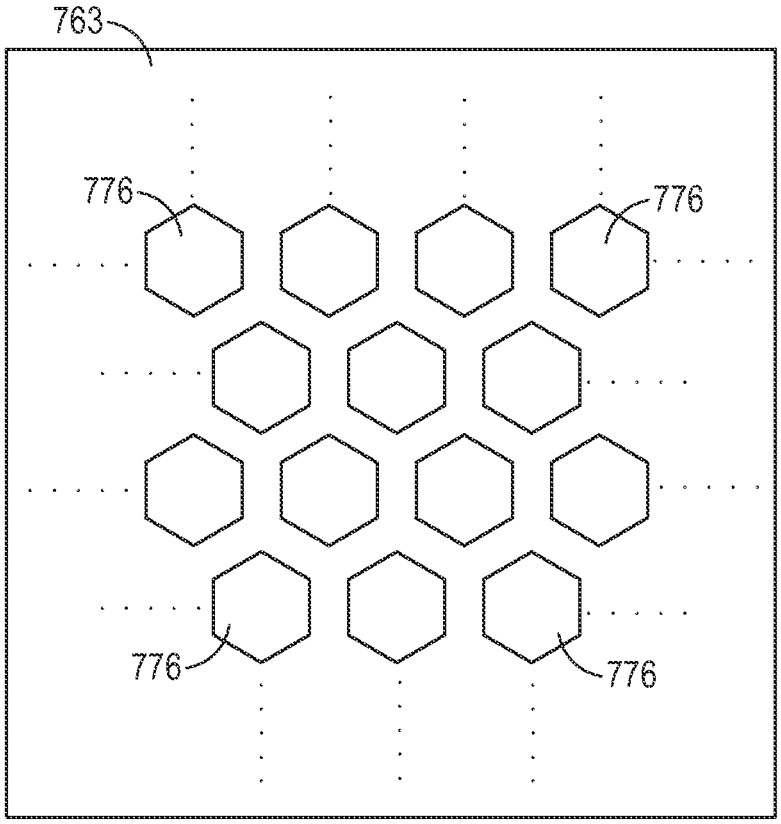
FIG. 27 is a top view schematic diagram of a substrate having an array of hexagon-shaped displacing electrodes.
Figure 28:
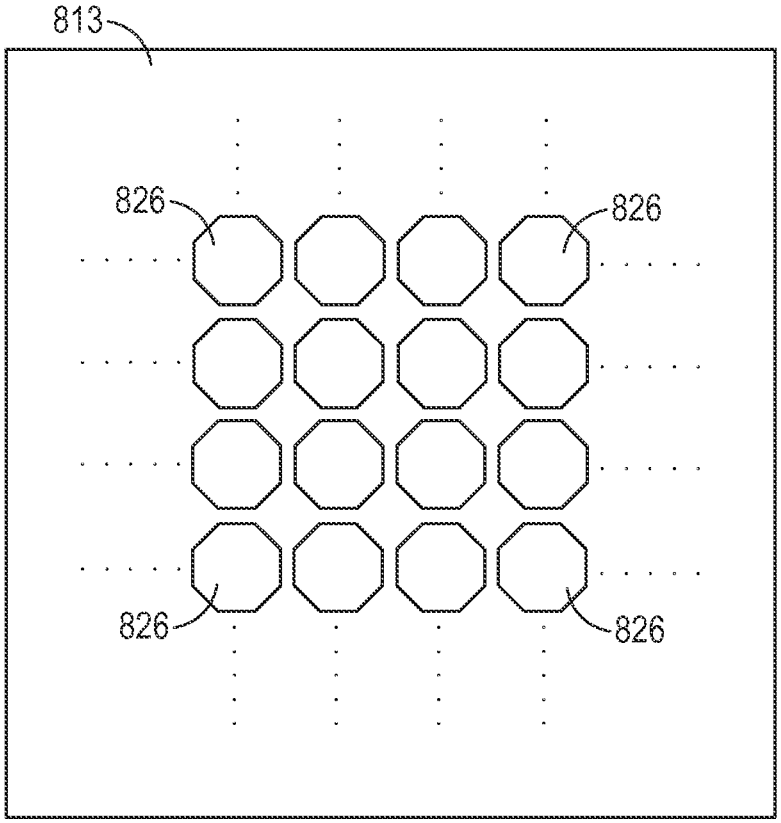
FIG. 28 is a top view schematic diagram of a substrate having an array of octagon-shaped displacing electrodes.

For example, referring to FIG. 24, a plurality of square-shaped displacing electrodes 626 are shown arranged in a two-dimensional array on the surface of a substrate 613. As shown in FIG. 25, an apparatus for providing a variable aperture to control electromagnetic radiation can comprise diamond-shaped displacing electrodes 676 arranged in a two-dimensional array on the surface of a substrate 663. As shown in FIG. 26, an apparatus for providing a variable aperture to control electromagnetic radiation can comprise triangle-shaped displacing electrodes 726 arranged in a two-dimensional array on the surface of a substrate 713. As shown in FIG. 27, an apparatus for providing a variable aperture to control electromagnetic radiation can comprise hexagon-shaped displacing electrodes 776 arranged in a two-dimensional array on the surface of a substrate 763. As shown in FIG. 28, an apparatus for providing a variable aperture to control electromagnetic radiation can comprise octagon-shaped displacing electrodes 826 arranged in a two-dimensional array on the surface of a substrate 813.

As described above, the substrates of an apparatus for providing a variable aperture to control electromagnetic radiation can comprise materials of construction such as, for example, aluminum, an aluminum alloy, glass, or silicon, or combinations of any thereof. If a substrate comprises an electrically conductive material such as aluminum or an aluminum alloy, the substrate itself may function as a charging electrode and provide electrical charge to the attenuation fluid in contact with the substrate. However, if a substrate comprises an electrically conductive material such as aluminum or an aluminum alloy, an insulator layer may be positioned between the substrate and the displacing electrodes located on the substrate to electrically isolate the displacing electrodes from the electrically conductive substrate. For example, although not shown in the drawings, a dielectric layer (e.g., a polymeric or ceramic coating) can be deposited over the entire gap-facing surface of a substrate, or deposited over at least the portions of the gap-facing surface of the substrate on which the displacing electrodes are located.

As described above, the attenuation fluid of an apparatus for providing a variable aperture to control electromagnetic radiation can comprise materials such as, for example, a fluid metal or fluid alloy (e.g., mercury, gallium-indium-tin alloys (Galinstan alloys gallium-indium-tin-zinc alloys, gallium-indium alloys, molten bismuth, or molten lead) or a nanofluid or microfluid (e.g., a suspension comprising lead or lead alloy particles in a base fluid). The substrate materials and the attenuation fluid should be mutually compatible and stable in contact (e.g., the attenuation fluid should not dissolve or oxidize the substrate material).

For example, mercury and Galinstan alloys readily dissolve and corrode aluminum; therefore, in embodiments comprising mercury or a Galinstan alloy attenuation fluid, the substrates should comprise a material such as glass or silicon, or aluminum substrates should be coated on at least the gap-facing surfaces with a material that is compatible with mercury or Galinstan alloys. Additionally, Galinstan alloys readily wet and adhere to glass; therefore, in embodiments comprising a Galinstan alloy attenuation fluid and glass substrates, the substrates should be coated on at least the gap-facing surfaces with a material such as gallium oxide, which prevents Galinstan alloys from wetting and strongly adhering to the glass surface.

Bismuth and lead are not in a fluid state at ambient temperatures and pressures; therefore, in embodiments comprising bismuth or lead attenuation fluid, an apparatus for providing a variable aperture to control electromagnetic radiation further comprises a heater to melt the bismuth or lead and form the attenuation fluid. For example, heating elements may be provided in the gap between the substrates, or in a fluid reservoir as described above.

As described above, the charging electrode(s) and the displacing electrode(s) of an apparatus for providing a variable aperture to control electromagnetic radiation can comprise conductors such as, for example, copper, silver, gold, nickel, palladium, platinum, chromium, molybdenum, tungsten, aluminum, or carbon (including metallic alloys comprising one or more of the listed metallic elements), or combinations of any thereof. The conductor material forming the charging electrode(s) should be compatible and stable in contact with the attenuation fluid (e.g., the attenuation fluid should not dissolve or oxidize the conductor material forming a charging electrode). The conductor material forming the displacing electrode(s) should adhere to the substrate material (or any underlying coating material deposited on the gap-facing surfaces of the substrate material, such as a dielectric layer, for example). The conductor material forming the displacing electrode(s) should also be compatible and stable in contact with the substrate material and the attenuation fluid.

As described above, the displacing electrode(s) of an apparatus for providing a variable aperture to control electromagnetic radiation can comprise thin-film electrodes, which can be formed, for example, by depositing and curing conductive inks or otherwise depositing the conductor material onto the gap-facing surfaces of the substrates (whether coated or uncoated, or in embedded depressions or directly on the surfaces). Additionally, an insulator layer can be deposited onto the displacing electrode(s), thus encapsulating the displacing electrode(s) and providing a barrier between the displacing electrode(s) and the attenuation fluid. The insulator layers and/or thin-film displacing electrodes can be deposited using techniques such as screen-printing, lithography, chemical vapor deposition, or physical vapor deposition. The insulator layer can comprise suitable dielectric or other electrically-insulating materials such as, for example, polymeric coatings (e.g., epoxies, acrylics, polyurethanes/polyureas, polyolefins, fluoropolymers, polysiloxanes, or the like) or ceramic coatings (e.g., silicon dioxide, aluminum oxide, titanium dioxide, or the like). The insulator materials and the attenuation fluid should be mutually compatible and stable in contact (e.g., the attenuation fluid should not dissolve or rapidly degrade the insulator material).

For clarity of illustration, the schematic diagrams described above are not drawn to scale. In implementation the substrates may have a thickness, for example, of 0.5 millimeters to 10 millimeters, or any sub-range subsumed therein, such as, for example, 1-10 mm, 1-7 mm, or 1-5 mm. The gap between the opposed and spaced apart substrates, which are generally parallel, may have a thickness (i.e., the perpendicular substrate-to-substrate distance) of 50 micrometers to 1,000 micrometers, or any sub-range subsumed therein, such as, for example, 50-500 μm, 100-300 μm, 150-250 μm, or 100-200 μm. The displacing electrode(s), when implemented as thin-film electrodes, may have a thickness of 0.5 micrometers to 50 micrometers, or any sub-range subsumed therein, such as, for example, 0.5-25 μm, 0.5-20 μm, 0.5-15 μm, or 0.5-10 μm. The insulating layers deposited over discharging electrodes may have a thickness of 0.5 micrometers to 50 micrometers, or any sub-range subsumed therein, such as, for example, 0.5-25 μm, 0.5-20 μm, 0.5-15 μm, or 0.5-10 μm.

An apparatus for providing a variable aperture may be used in a method for controlling electromagnetic radiation. A method for controlling electromagnetic radiation may comprise displacing an attenuation fluid with an electrostatic force between an attenuation fluid and a displacing electrode. The displacing of the attenuation fluid changes the location, size, and/or shape of an open aperture in a layer of the attenuation fluid. Electromagnetic radiation (e.g., X-rays having a wavelength in the range of 0.01 to 10 nanometers) can propagate through the open aperture in the attenuation fluid layer.

Figure 29:
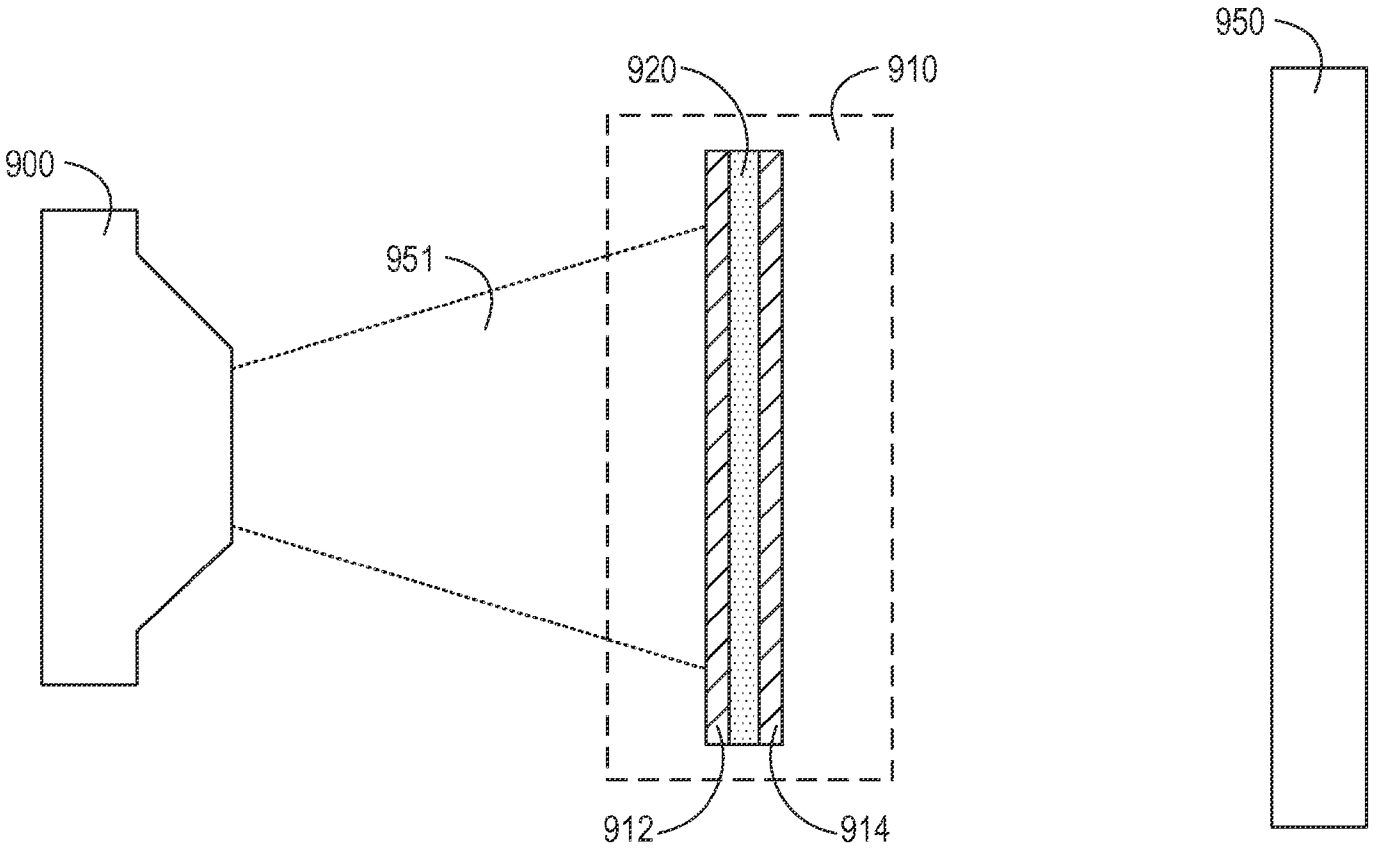
FIG. 29 is a schematic diagram of an X-ray system comprising an apparatus for providing a variable aperture to control an X-ray beam.

An apparatus for providing a variable aperture may be used in an electromagnetic radiation system such as, for example, an X-ray system. Referring to FIG. 29, an X-ray system comprises an X-ray source 900 providing an X-ray beam 951 contacting an apparatus 910 for providing a variable X-ray aperture. The apparatus 910 is located between the X-ray source 900 and a target 950, which may be an X-ray detector for example. In embodiments wherein the target 950 is an X-ray detector, an additional target (not shown) (e.g., a patient or other object to be examined by the X-rays) may be located between the apparatus 910 and the detector 950. The apparatus 910 for providing a variable X-ray aperture generally comprises a first substrate 912, a second substrate 914, an attenuation fluid 920 located in the gap first substrate 912 and the second substrate 914, at least one charging electrode (not shown), and one or more displacing electrodes (not shown). The apparatus 910 can comprise any of the features or characteristics described above, and in any combination.

Figure 30A:
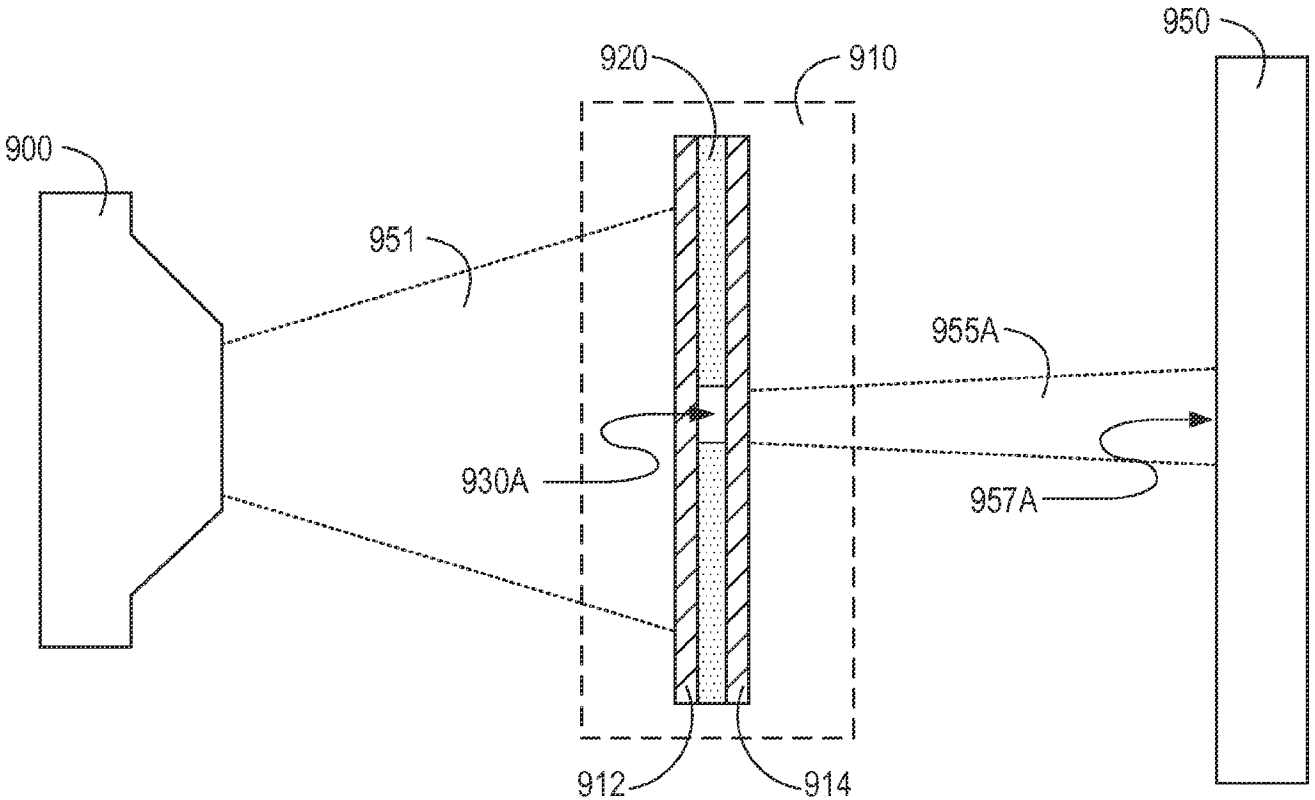
FIG. 30A is a schematic diagram of the X-ray system shown in FIG. 29 with the apparatus controlled to provide an X-ray aperture collimating an X-ray beam.
Figure 30B:
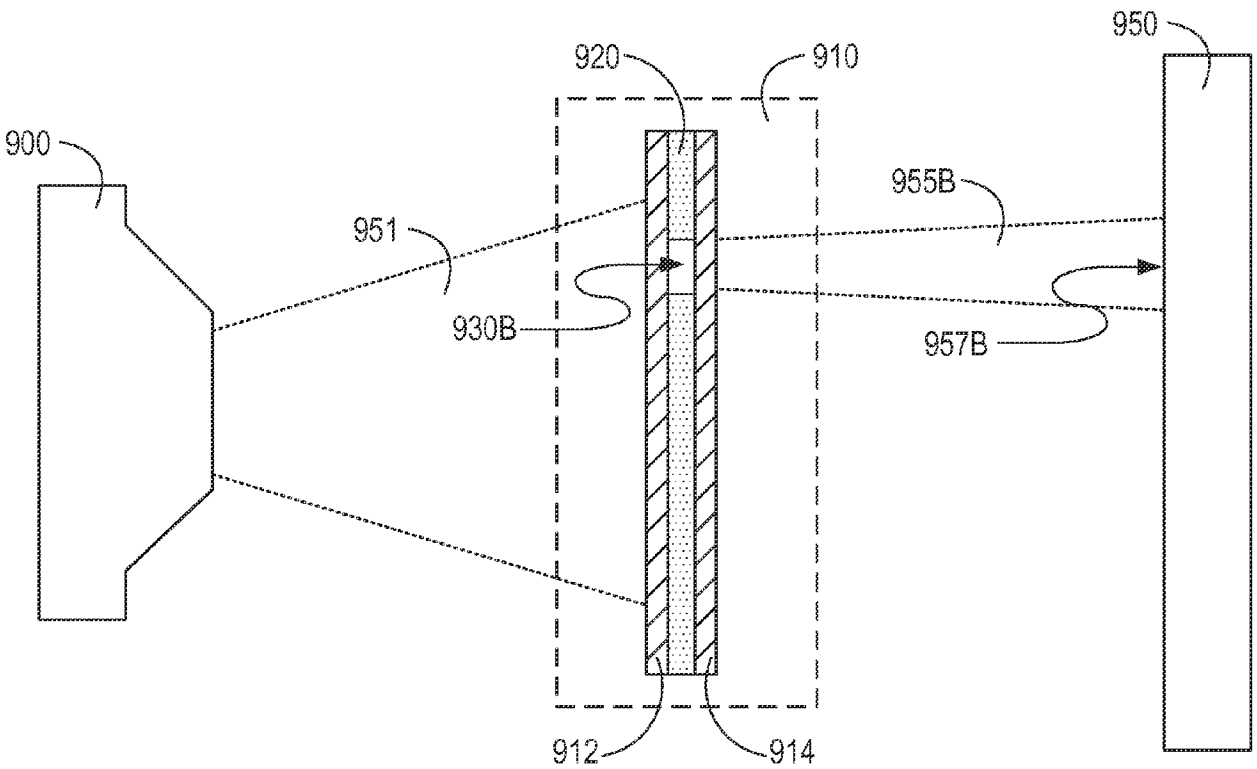
FIG. 30B is a schematic diagram of the X-ray system shown in FIG. 30A with the apparatus controlled to change the location-on-target of the collimated X-ray beam.
Figure 30C:
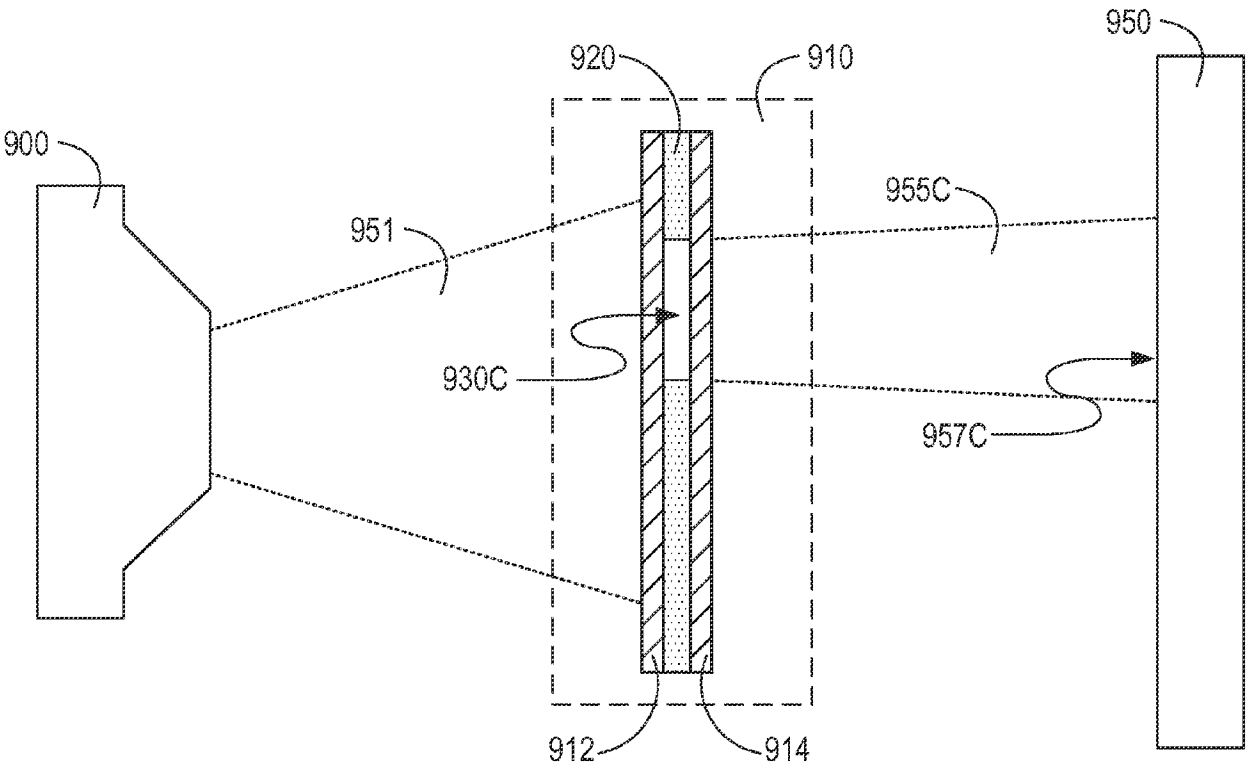
FIG. 30C is a schematic diagram of the X-ray system shown in FIG. 30B with the apparatus controlled to change the size of the collimated X-ray beam.
Figure 30D:
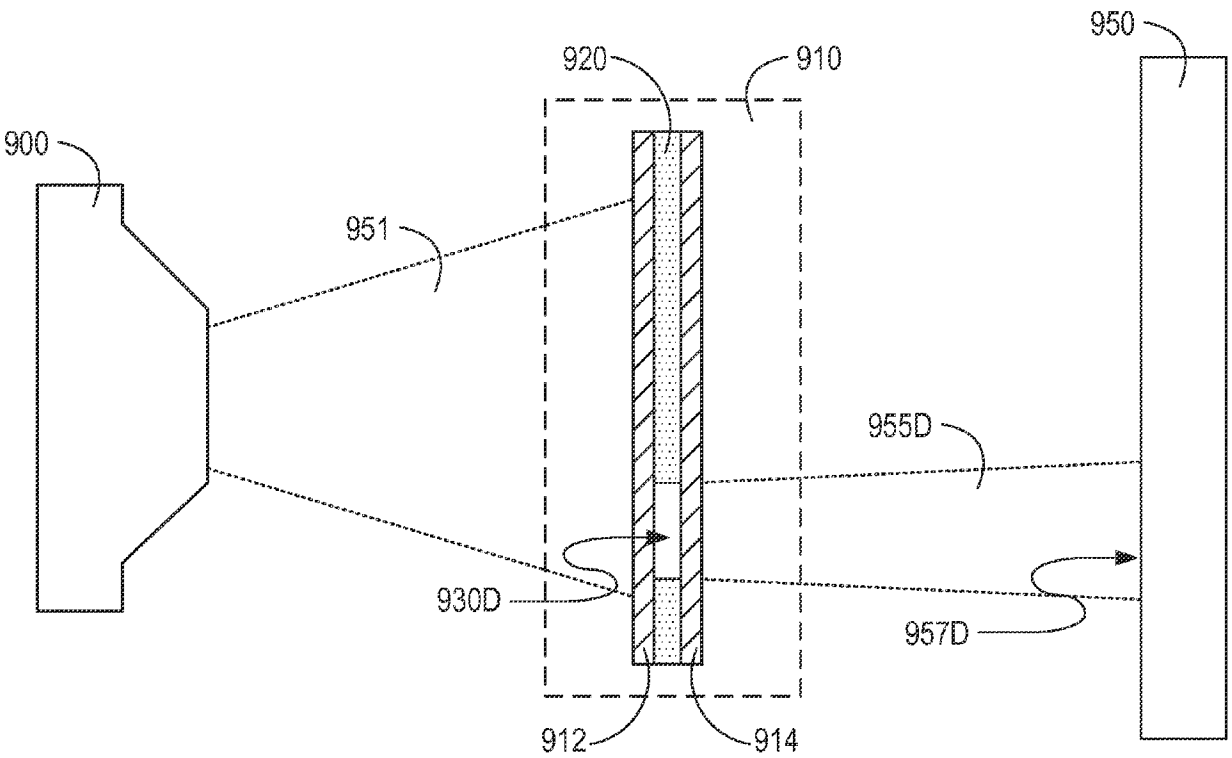
FIG. 30D is a schematic diagram of the X-ray system shown in FIG. 30C with the apparatus controlled to change the location, size, and shape of the collimated X-ray beam.
Figure 31A:
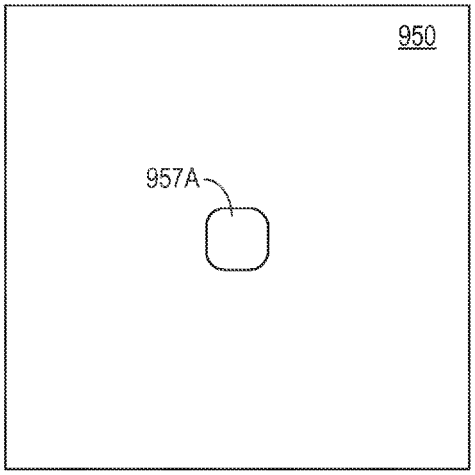
FIG. 31A is a schematic diagram illustrating the location-on-target, size, and shape of the collimated X-ray beam incident on the target shown in FIG. 30A.
Figure 31B:
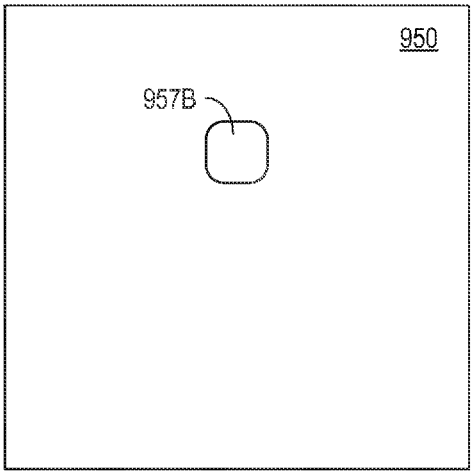
FIG. 31B is a schematic diagram illustrating the location-on-target, size, and shape of the collimated X-ray beam incident on the target shown in FIG. 30B.
Figure 31C:
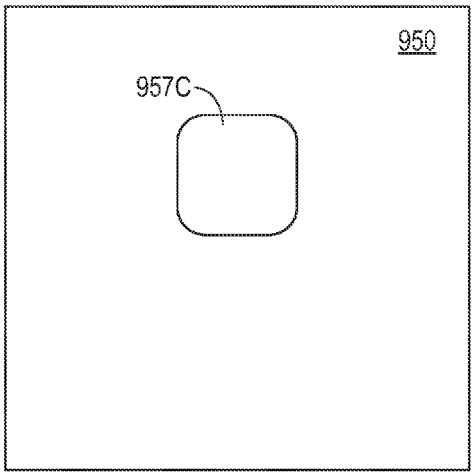
FIG. 31C is a schematic diagram illustrating the location-on-target, size, and shape of the collimated X-ray beam incident on the target shown in FIG. 30C.
Figure 31D:
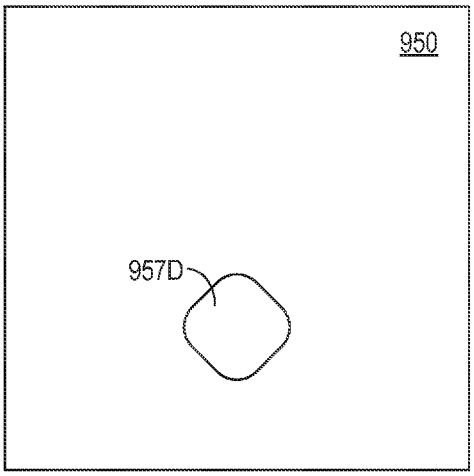
FIG. 31D is a schematic diagram illustrating the location-on-target, size, and shape of the collimated X-ray beam incident on the target shown in FIG. 30D.

As shown in FIG. 29, the layer of attenuation fluid 920 does not comprise any open aperture and completely absorbs and blocks incident X-ray beam 951. As shown in FIG. 30A, the attenuation fluid 920 is displaced with an electrostatic force between the attenuation fluid and one or more displacing electrodes (not shown) to provide an open aperture 930A through which X-rays propagate to form collimated X-ray beam 955A. The collimated X-ray beam 955A contacts the target 950 at contact area 957A. Referring to FIG. 30B, by controlling the respective charge states of the displacing electrode(s) (not shown) and the attenuation fluid 920, the location of the open aperture 930B can be dynamically varied, for example, to provide a collimated X-ray beam 955B with a different contact area 957B on the target 950. Referring to FIG. 30C, by controlling the respective charge states of the displacing electrode(s) (not shown) and the attenuation fluid 920, the size of the open aperture 955C can be dynamically varied, for example, to provide a collimated X-ray beam 955C with a larger cross-sectional area and therefore a larger contact area 957C. Referring to FIG. 30D, by controlling the respective charge states of the displacing electrode(s) (not shown) and the attenuation fluid 920, the location, size, and shape of the open aperture 955D can be dynamically varied, for example, to provide a collimated X-ray beam 955D with a different location, cross-sectional area, and cross-sectional shape and therefore a contact area 957D having a different location, cross-sectional area, and cross-sectional shape.

FIGS. 31A-31D respectively show the contact areas 957A-957D of the collimated X-ray beams 955A-955D produced by the dynamically controlled apertures 930A-930D shown in FIGS. 30A-30D. As shown, by controlling the respective charge states of the displacing electrode(s) and the attenuation fluid, the location, size, and/or shape of the open aperture can be dynamically varied to produce collimated X-ray beams having dynamically controllable propagation direction (i.e., location-on-target), cross-sectional size, and/or cross-sectional shape.

As described above, by controlling the respective electrical charge states of displacing electrodes and attenuation fluid, the location, size, and/or shape of an open aperture through the attenuation fluid layer can be dynamically varied, thus dynamically controlling the location, size, and/or shape of an electromagnetic radiation beam propagating through the open aperture in the attenuation fluid layer. The polarity and magnitude of the electrical charge provided to the displacing electrodes and the attenuation fluid can be independently controlled to induce electrostatic attraction and/or repulsion between the attenuation fluid and the independently controlled displacing electrodes.

For example, referring again to FIGS. 7A-10B, the attenuation fluid 70 can be negatively charged by the charging electrode 68, and the displacing electrodes 76A and 76B can likewise be negatively charged. The electrostatic repulsion between the negatively-charged attenuation fluid 70 and the negatively-charged displacing electrodes 76A and 76B displaces the attenuation fluid 70 and forms the open aperture 80. The displacing electrodes 77A, 77B, 79A, and 79B can also be negatively charged, thus further inducing electrostatic repulsion and further displacing the attenuation fluid 70 and increasing the size of the open aperture 80.

Additionally, referring to FIG. 9A, the attenuation fluid 70 can be negatively charged by the charging electrode 68, the displacing electrodes 76A, 76B, 77A, and 77B can be negatively charged, and the displacing electrodes 79A and 79B can be positively charged. The electrostatic repulsion induced between the negatively-charged attenuation fluid 70 and the negatively-charged displacing electrodes 76A, 76B, 77A, and 77B, combined with the electrostatic attraction induced between the negatively-charged displacing electrodes and the positively-charged displacing electrodes 79A and 79B, displaces the attenuation fluid 70 and forms the open aperture 80.

The specific charge polarity and magnitude provided to attenuation fluids and each displacing electrode can be independently controlled to change the location, size, and/or shape of an open aperture through attenuation fluid layers, thus producing collimated electromagnetic radiation beams (e.g., X-ray beams) having dynamically controllable propagation direction (i.e., location-on-target), cross-sectional size, and/or cross-sectional shape.

The methods and apparatus described in this specification can be employed in a number of applications such as, for example, X-ray imaging (medical and non-medical), medical radiotherapy, X-ray non-destructive testing and examination, or any other X-ray systems in which it is desirable to dynamically control the propagation direction (i.e., location-on-target), cross-sectional size, and/or cross-sectional shape of X-ray beams. For instance, in dental X-ray imaging and medical imaging applications (e g, mammography, surgical X-ray, and the like), the X-ray dose should be "As Low As Reasonably Attainable" (ALARA) and still produce an acceptable radiography image. ALARA principles define actions and recommendations to minimize patient radiation exposure without compromising the information content in the image produced by an X-ray examination. A key ALARA principle for X-ray examination is the collimation of X-ray beams to limit the exposed area to only the region of interest. The methods and apparatus described in this specification may facilitate this ALARA principle by providing dynamically controllable collimation, in real-time, which allows for reduction or minimization of exposure area.

Conventional X-ray collimator apertures are generally characterized by static rectangular or circular shapes formed in solid material, which are not readily changeable, and which generally do not match the shape of a region of interest for an examination. Thus, conventional X-ray collimator apertures pass more radiation than necessary to accurately examine a region of interest with acceptable resolution, which violates ALARA principles. By dynamically controlling the location, size, and/or shape of an open aperture through an attenuation fluid layer, the methods and apparatus described in this specification may collimate X-ray beams that more closely match the location, shape, and size of a region of interest, and thus reduce or minimize radiation exposure in accordance with ALARA principles. The methods and apparatus described in this specification may be integrated into medical and non-medical X-ray imaging equipment to provide for adequate collimation of the X-ray beam and simultaneously reduce X-ray exposure outside of the region of interest.

The methods and apparatus described in this specification may also provide real-time radiation dose control and beam alignment by dynamically controlling the location, size, and/or shape of an open aperture through an attenuation fluid layer. In this manner, for example, an X-ray beam can be aligned with an X-ray detector using software calibration implemented by a controller, instead of physical hardware alignment which must be performed when an X-ray system is off-line. Dynamic control of the location, size, and/or shape of an open aperture through an attenuation fluid layer may also facilitate the real-time focusing and/or scanning/rastering of a collimated X-ray beam on an examination target. In contrast, changing the collimation provided by conventional X-ray apertures requires physically changing out aperture devices of different sizes/shapes, and scanning/rastering with conventional X-ray apertures requires moving the entire X-ray source or the examination target relative to each other. Both of these operations typically require turning the X-ray source off and making the changes off-line, whereas the methods and apparatus described in this specification may allow such changes to be made on-line and in real-time.

The methods and apparatus described in this specification may also improve the image quality produced in X-ray imaging (both medical and non-medical). In X-ray imaging, scattered X-rays—i.e., X-rays that passed through an examination target but deflected from their original direction of propagation and thus do not carry useful information about the examination target—decrease image quality by reducing contrast and introducing non-uniformities and other artifacts. X-ray imaging systems generally include specialized hardware and software to compensate for scattered X-ray radiation by physically blocking the scattered radiation from reaching the X-ray detector or processing the signals produced by the scattered radiation that reaches the detector to remove the effects from the resulting images. By controlling the incident area of an X-ray beam to more closely match the location, shape, and size of a region of interest, the methods and apparatus described in this specification may reduce scattered X-rays and provide better image contrast and overall quality.

Other advantages provided by the methods and apparatus described in this specification include increasing the information content of images produced by X-ray examinations. For instance, a region of interest may have different properties that require different X-ray intensities for optimal imaging (e.g., nipple area versus surrounding breast tissue in mammography). To address this, an X-ray beam can be collimated through an aperture that increases in size in real-time during an X-ray examination with a corresponding change in X-ray intensity that is better suited for imaging the newly exposed area. As a result, the image area increases in real-time during the examination and the signals produced by an X-ray detector over the duration of the examination can be balanced to provide an optimal image with more information compared to an image provided by a static aperture with a beam of constant intensity. This functionality may improve imaging performance while also reducing the detector's required dynamic range and thus the cost of the imaging hardware. In this manner, a dynamically controllable aperture may expand and improve the procedures and protocols for X-ray imaging and examination.

Additionally, the methods and apparatus described in this specification may facilitate scanning at different depths in an examination target with different X-ray intensities (i.e., a three-dimensional intensity profile) to provide a three-dimensional image, or a computed tomography-like image, with a static X-ray system.

EXAMPLES

Various features and characteristics of examples of the invention include, but are not limited to, the following numbered clauses:

1. An apparatus for providing a variable aperture to control electromagnetic radiation, the apparatus comprising: a first substrate; a second substrate located opposite the first substrate and spaced apart from the first substrate to form a gap between the first substrate and the second substrate; an attenuation fluid located in the gap between the first substrate and the second substrate, the attenuation fluid configured to absorb electromagnetic radiation of a predetermined wavelength; at least one charging electrode in electrical contact with the attenuation fluid; and at least one displacing electrode located on a surface of the first substrate facing the gap or on a surface of the second substrate facing the gap.

2. The apparatus of clause 1, wherein the attenuation fluid is configured to absorb electromagnetic radiation having a wavelength in the range of 0.01 to 10 nanometers.

3. The apparatus of clause 1 or clause 2, further comprising a controller operably coupled to the at least one displacing electrode.

4. The apparatus of clause 3, wherein the controller is configured to provide an electrical charge to the displacing electrode to displace the attenuation fluid from at least a portion of the gap by electrostatic force between the displacing electrode and the attenuation fluid.

5. The apparatus of any one of clauses 1-4, wherein the attenuation fluid forms a fluid layer in contact with the surface of the first substrate facing the gap and the surface of the second substrate facing the gap.

6. The apparatus of any one of clauses 1-5, further comprising a fluid reservoir in fluid communication with the attenuation fluid located in the gap between the first substrate and the second substrate.

7. The apparatus of clause 6, wherein the fluid reservoir is configured to releasably hold attenuation fluid displaced from at least a portion of the gap by electrostatic force between the at least one displacing electrode and the attenuation fluid.

8. The apparatus of clause 6, wherein the fluid reservoir is located at a perimeter of the gap between the first substrate and the second substrate.

9. The apparatus of any one of clauses 1-8, wherein the at least one displacing electrode comprises a thin-film electrode deposited on the surface of the first substrate facing the gap or on the surface of the second substrate facing the gap.

10. The apparatus of any one of clauses 1-9, wherein the at least one displacing electrode comprises at least two displacing electrodes, a first displacing electrode located on the surface of the first substrate facing the gap, and a second displacing electrode located on the surface of the second substrate facing the gap.

11. The apparatus of any one of clauses 1-10, wherein the at least one displacing electrode comprises a plurality of displacing electrodes comprising an annular shape and arranged concentrically on the surface of the first substrate facing the gap and/or on the surface of the second substrate facing the gap.

12. The apparatus of any one of clauses 1-10, wherein the at least one displacing electrode comprises a plurality of displacing electrodes arranged in an array on the surface of the first substrate facing the gap and/or on the surface of the second substrate facing the gap.

13. The apparatus of any one of clauses 1-12, wherein the attenuation fluid comprises a fluid metal or fluid alloy.

14. The apparatus of clause 13, wherein the attenuation fluid comprises mercury.

15. The apparatus of any one of clauses 1-14, wherein the first substrate and the second substrate independently comprise aluminum, glass, or silicon, or combinations of any thereof.

16. The apparatus of any one of clauses 1-15, further comprising an insulator layer located over the at least one displacing electrode and forming a barrier between the at least one displacing electrode and the attenuation fluid.

17. An apparatus for providing a variable X-ray aperture, the apparatus comprising: a first substrate; a second substrate located opposite the first substrate and spaced apart from the first substrate to form a gap between the first substrate and the second substrate; an X-ray attenuation fluid located in the gap between the first substrate and the second substrate; at least one charging electrode in electrical contact with the X-ray attenuation fluid; and at least one displacing electrode located on a surface of the first substrate facing the gap or on a surface of the second substrate facing the gap.

18. The apparatus of clause 17, further comprising a controller operably coupled to the at least one displacing electrode.

19. The apparatus of clause 18, wherein the controller is configured to provide an electrical charge to the displacing electrode to displace the X-ray attenuation fluid from at least a portion of the gap by electrostatic force between the displacing electrode and the X-ray attenuation fluid.

20. The apparatus of any one of clauses 17-19, wherein the X-ray attenuation fluid forms a fluid layer in contact with the surface of the first substrate facing the gap and the surface of the second substrate facing the gap.

21. The apparatus of any one of clauses 17-20, further comprising a fluid reservoir in fluid communication with the X-ray attenuation fluid located in the gap between the first substrate and the second substrate.

22. The apparatus of clause 21, wherein the fluid reservoir is configured to releasably hold X-ray attenuation fluid displaced from at least a portion of the gap by electrostatic force between the at least one displacing electrode and the X-ray attenuation fluid.

23. The apparatus of clause 21, wherein the fluid reservoir is located at a perimeter of the gap between the first substrate and the second substrate.

24. The apparatus of any one of clauses 17-23, wherein the at least one displacing electrode comprises a thin-film electrode deposited on the surface of the first substrate facing the gap or on the surface of the second substrate facing the gap.

25. The apparatus of any one of clauses 17-24, wherein the at least one displacing electrode comprises at least two displacing electrodes, a first displacing electrode located on the surface of the first substrate facing the gap, and a second displacing electrode located on the surface of the second substrate facing the gap.

26. The apparatus of any one of clauses 17-25, wherein the at least one displacing electrode comprises a plurality of displacing electrodes comprising an annular shape and arranged concentrically on the surface of the first substrate facing the gap and/or on the surface of the second substrate facing the gap.

27. The apparatus of any one of clauses 17-25, wherein the at least one displacing electrode comprises a plurality of displacing electrodes arranged in an array on the surface of the first substrate facing the gap and/or on the surface of the second substrate facing the gap.

28. The apparatus of any one of clauses 17-27, wherein the X-ray attenuation fluid comprises a fluid metal or fluid alloy.

29. The apparatus of clause 28, wherein the X-ray attenuation fluid comprises mercury.

30. The apparatus of any one of clauses 17-29, wherein the first substrate and the second substrate independently comprise aluminum, glass, or silicon, or combinations of any thereof.

31. The apparatus of any one of clauses 17-20, further comprising an insulator layer located over the at least one displacing electrode and forming a barrier between the at least one displacing electrode and the attenuation fluid.

32. An apparatus for providing a variable X-ray aperture, the apparatus comprising: a first substrate; a second substrate located opposite the first substrate, and spaced apart from the first substrate to form a gap between the first substrate and the second substrate; a mercury layer located in the gap between the first substrate and the second substrate, the mercury layer in contact with a surface of the first substrate facing the gap and a surface of the second substrate facing the gap; at least one charging electrode in electrical contact with the mercury layer; at least one displacing electrode located on the surface of the first substrate facing the gap or on the surface of the second substrate facing the gap; and a controller operably coupled to the at least one displacing electrode; wherein the controller is configured to provide the displacing electrode with an electrical charge that displaces the mercury layer from at least a portion of the gap by electrostatic force between the displacing electrode and the mercury layer.

33. The apparatus of clause 32, further comprising a fluid reservoir in fluid communication with the mercury layer located in the gap between the first substrate and the second substrate, wherein the fluid reservoir is configured to releasably hold mercury displaced from at least a portion of the gap by electrostatic force between the at least one displacing electrode and the mercury.

34. The apparatus of clause 32 or clause 33, wherein the at least one displacing electrode comprises a plurality of thin-film electrodes deposited on the surface of the first substrate facing the gap and on the surface of the second substrate facing the gap, wherein the plurality of displacing electrodes comprise an annular shape and are arranged concentrically, or wherein the plurality of displacing electrodes are arranged in an array, on the surface of the first substrate facing the gap and/or on the surface of the second substrate facing the gap.

35. The apparatus of any one of clauses 32-34, wherein the first substrate and the second substrate independently comprise a material selected from the group consisting of aluminum, glass, silicon, and combinations of any thereof.

36. The apparatus of any one of clauses 32-35, further comprising an insulator layer located over the at least one displacing electrode and forming a barrier between the at least one displacing electrode and the attenuation fluid.

37. An X-ray system comprising: an X-ray source; an X-ray detector; and the apparatus of any one of clauses 1-36 located between the X-ray source and the X-ray detector.

38. A method for controlling electromagnetic radiation comprising: displacing an attenuation fluid with an electrostatic force between the attenuation fluid and a displacing electrode, wherein the displacing changes the location, size, and/or shape of an open aperture in a layer of the attenuation fluid; and providing electromagnetic radiation through the open aperture in the attenuation fluid layer.

39. A method for controlling X-ray radiation comprising: displacing an X-ray attenuation fluid with an electrostatic force between the X-ray attenuation fluid and a displacing electrode, wherein the displacing changes the location, size, and/or shape of an open aperture in a layer of the X-ray attenuation fluid; and providing X-ray radiation through the open aperture in the X-ray attenuation fluid layer.

Various features and characteristics of the inventions are described in this specification and illustrated in the drawings to provide an overall understanding of the disclosed apparatus, methods, and systems. It is understood that the various features and characteristics described in this specification and illustrated in the drawings can be combined in any suitable manner regardless of whether such features and characteristics are expressly described or illustrated in combination in this specification. The Applicant expressly intends such combinations of features and characteristics to be included within the scope of this specification. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with written description, sufficiency of description, and added matter requirements (e.g., 35 U.S.C. §112(a) and Article 123(2) EPC). The apparatus, methods, and systems described in this specification can comprise, consist of, or consist essentially of the various features and characteristics described in this specification.

Also, any numerical range recited in this specification describes all sub-ranges of the same numerical precision (i.e., having the same number of specified digits) subsumed within the recited range. For example, a recited range of "1.0 to 10.0" describes all sub-ranges between (and including) the recited minimum value of 1.0 and the recited maximum value of 10.0, such as, for example, "2.4 to 7.6," even if the range of "2.4 to 7.6" is not expressly recited in the text of the specification. Accordingly, the Applicant reserves the right to amend this specification, including the claims, to expressly recite any sub-range of the same numerical precision subsumed within the ranges expressly recited in this specification. All such ranges are inherently described in this specification such that amending to expressly recite any such sub-ranges will not add new matter to the specification or claims, and will comply with written description, sufficiency of description, and added matter requirements (e.g., 35 U.S.C. §112(a) and Article 123(2) EPC). Additionally, numerical parameters described in this specification should be construed in light of the number of reported significant digits, the numerical precision of the number, and by applying ordinary rounding techniques. It is also understood that numerical parameters described in this specification will necessarily possess the inherent variability characteristic of the underlying measurement techniques used to determine the numerical value of the parameter.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and can be employed or used in an implementation of the described processes, compositions, and products. Further, the use of a singular noun includes the plural, and the use of a plural noun includes the singular, unless the context of the usage requires otherwise.

What is claimed is:

1. An apparatus for providing a variable X-ray aperture, the apparatus comprising:

a first substrate;

a second substrate located opposite the first substrate and spaced apart from the first substrate to form a gap between the first substrate and the second substrate;

an X-ray attenuation fluid located in the gap between the first substrate and the second substrate;

at least one charging electrode in electrical contact with the X-ray attenuation fluid; and at least one displacing electrode located on a surface of the first substrate facing the gap or on a surface of the second substrate facing the gap, wherein the displacing electrode is configured to displace the X-ray attenuation fluid to provide an aperture within the X-ray attenuation fluid.

2. The apparatus of claim 1, further comprising a controller operably coupled to the at least one displacing electrode.

3. The apparatus of claim 1, wherein the X-ray attenuation fluid forms a fluid layer in contact with the surface of the first substrate facing the gap and the surface of the second substrate facing the gap.

4. The apparatus of claim 1, further comprising a fluid reservoir in fluid communication with the X-ray attenuation fluid located in the gap between the first substrate and the second substrate.

5. The apparatus of claim 1, wherein the at least one displacing electrode comprises a thin-film electrode deposited on the surface of the first substrate facing the gap or on the surface of the second substrate facing the gap.

6. The apparatus of claim 1, wherein the at least one displacing electrode comprises at least two displacing electrodes, a first displacing electrode located on the surface of the first substrate facing the gap, and a second displacing electrode located on the surface of the second substrate facing the gap.

7. The apparatus of claim 1, wherein the at least one displacing electrode comprises a plurality of displacing electrodes comprising an annular shape and arranged concentrically on the surface of the first substrate facing the gap and/or on the surface of the second substrate facing the gap.

8. The apparatus of claim 1, wherein the at least one displacing electrode comprises a plurality of displacing electrodes arranged in an array on the surface of the first substrate facing the gap and/or on the surface of the second substrate facing the gap.

9. The apparatus of claim 1, wherein the X-ray attenuation fluid comprises a fluid metal or fluid alloy.

10. The apparatus of claim 1, wherein the first substrate and the second substrate independently comprise aluminum, glass, or silicon, or combinations of any thereof.

11. The apparatus of claim 2, wherein the controller is configured to provide an electrical charge to the displacing electrode to displace the X-ray attenuation fluid from at least a portion of the gap by electrostatic force between the displacing electrode and the X-ray attenuation fluid.

12. The apparatus of claim 4, wherein the fluid reservoir is configured to releasably hold X-ray attenuation fluid displaced from at least a portion of the gap by electrostatic force between the at least one displacing electrode and the X-ray attenuation fluid.

13. The apparatus of claim 4, wherein the fluid reservoir is located at a perimeter of the gap between the first substrate and the second substrate.

14. The apparatus of claim 9, wherein the X-ray attenuation fluid comprises mercury.

15. An apparatus for providing a variable X-ray aperture, the apparatus comprising:

a first substrate;

a second substrate located opposite the first substrate, and spaced apart from the first substrate to form a gap between the first substrate and the second substrate;

a mercury layer located in the gap between the first substrate and the second substrate, the mercury layer in contact with a surface of the first substrate facing the gap and a surface of the second substrate facing the gap;

at least one charging electrode in electrical contact with the mercury layer;

at least one displacing electrode located on the surface of the first substrate facing the gap or on the surface of the second substrate facing the gap; and a controller operably coupled to the at least one displacing electrode;

wherein the controller is configured to provide the displacing electrode with an electrical charge that displaces the mercury layer from at least a portion of the gap by electrostatic force between the displacing electrode and the mercury layer to provide an aperture within the attenuation fluid.

16. The apparatus of claim 15, further comprising a fluid reservoir in fluid communication with the mercury layer located in the gap between the first substrate and the second substrate, wherein the fluid reservoir is configured to releasably hold mercury displaced from at least a portion of the gap by electrostatic force between the at least one displacing electrode and the mercury.

17. The apparatus of claim 15, wherein the at least one displacing electrode comprises a plurality of thin-film electrodes deposited on the surface of the first substrate facing the gap and on the surface of the second substrate facing the gap, wherein the plurality of displacing electrodes comprise an annular shape and are arranged concentrically, or wherein the plurality of displacing electrodes are arranged in an array, on the surface of the first substrate facing the gap and/or on the surface of the second substrate facing the gap.

18. The apparatus of claim 15, wherein the first substrate and the second substrate independently comprise a material selected from the group consisting of aluminum, glass, silicon, and combinations of any thereof.

19. An apparatus for providing a variable aperture to control electromagnetic radiation, the apparatus comprising:

a first substrate;

a second substrate located opposite the first substrate and spaced apart from the first substrate to form a gap between the first substrate and the second substrate;

an attenuation fluid located in the gap between the first substrate and the second substrate, the attenuation fluid configured to absorb electromagnetic radiation of a predetermined wavelength;

at least one charging electrode in electrical contact with the attenuation fluid; and at least one displacing electrode located on a surface of the first substrate facing the gap or on a surface of the second substrate facing the gap, wherein the displacing electrode is configured to displace the attenuation fluid to provide an aperture within the attenuation fluid.

20. The apparatus of claim 19, wherein the attenuation fluid is configured to absorb electromagnetic radiation having a wavelength in the range of 0.01 to 10 nanometers.

* * * * *